United States Patent [19]

Potucek et al.

[11] 3,930,297

[45] Jan. 6, 1976

[54] FASTENER FEED APPARATUS AND METHOD

[75] Inventors: Frank R. Potucek, Des Plaines; Allen R. Obergfell, Park Ridge, both of Ill.

[73] Assignee: Duo-Fast Corporation, Franklin Park, Ill.

[22] Filed: Nov. 5, 1973

[21] Appl. No.: 412,684

[52] U.S. Cl. ..... 29/431; 29/211 R; 29/240; 29/432; 29/526; 144/32; 144/309 R; 144/313; 206/347; 221/71; 221/74; 226/62; 227/95; 227/136

[51] Int. Cl.[2] ..... B25B 23/04; B65D 85/24; B21D 39/03

[58] Field of Search .... 226/62; 227/95, 136, 309 R; 144/32, 313; 29/429, 431, 211 R, 240, 432, 526; 221/70, 71, 74; 206/338, 341, 347

[56] References Cited

UNITED STATES PATENTS

| | | | |
|---|---|---|---|
| 2,009,580 | 7/1935 | Govanus | 227/136 |
| 3,374,934 | 3/1968 | Dickson | 227/136 X |
| 3,543,987 | 12/1970 | Obergfell | 227/136 |
| 3,550,831 | 12/1970 | Obergfell | 227/136 |
| 3,554,246 | 1/1971 | Halstead | 227/136 X |

*Primary Examiner*—J. M. Meister
*Assistant Examiner*—W. D. Bray
*Attorney, Agent, or Firm*—Mason, Kolehmainen, Rathburn & Wyss

[57] ABSTRACT

A fastener feed assembly for a tool such as a power screwdriver having a drive member such as a rotatable bit includes a base fixed to the tool and a nose assembly slidably related to the base. The nose assembly includes a workpiece engaging surface, and when the tool is moved toward the workpiece during a fastener driving operation, the base moves toward the nose assembly. A return spring separates the base and nose assembly when the tool is withdrawn away from the workpiece. A strip of fasteners is fed from a magazine along a feed path through the nose assembly with sequential fasteners located in a drive position. Normally the drive member is spaced from a fastener in the drive position. During movement of the tool toward the workpiece in a driving operation, the drive member moves into engagement with a fastener in the drive position, and then continues to move in order to drive the fastener into the workpiece. A pawl is engageable with the strip in order to advance the strip along the feed path. During the driving operation, a feed mechanism operates in response to movement of the base toward the nose assembly to cock the pawl by moving it away from its home position along the strip away from the drive position. A lost motion arrangement delays cocking of the pawl until after secure engagement of the drive member with a fastener in the drive position. In response to withdrawal of the tool from the workpiece, the feed mechanism returns the pawl to its home position to feed an adjacent fastener of the strip to the drive position. Feed movement of the pawl is delayed until withdrawal of the drive member from the strip feed path. The strip includes a carrier with structure deformed during the drive operation for preventing reverse movement of the strip during cocking of the pawl.

23 Claims, 36 Drawing Figures

Fig. 2
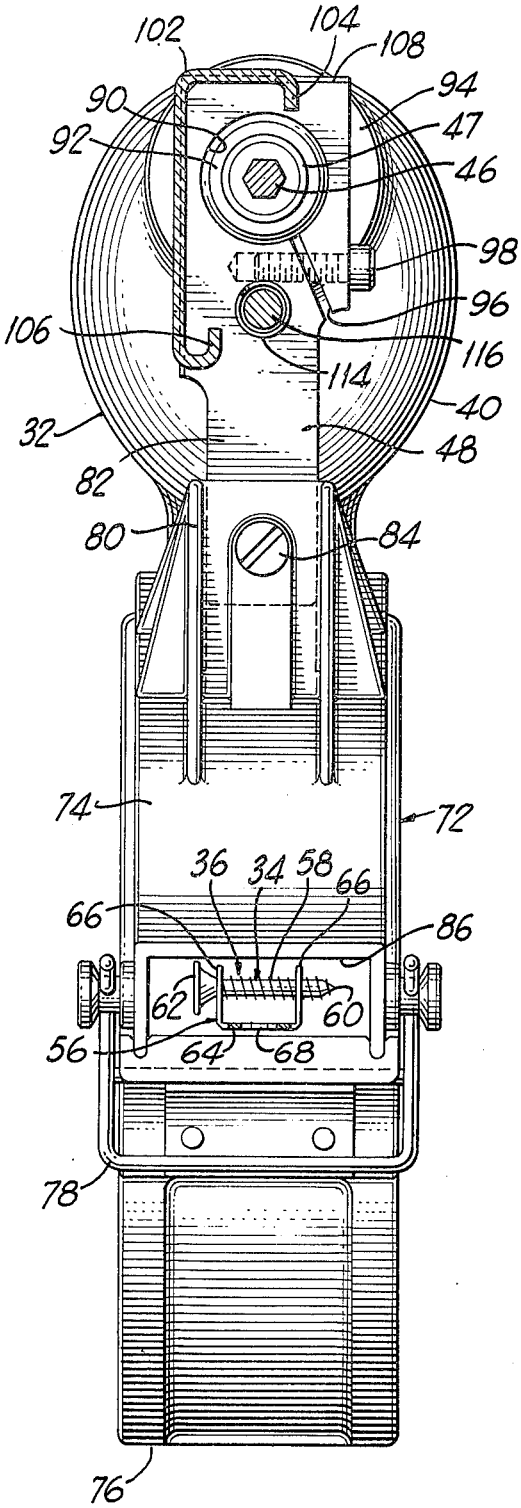
Fig. 3
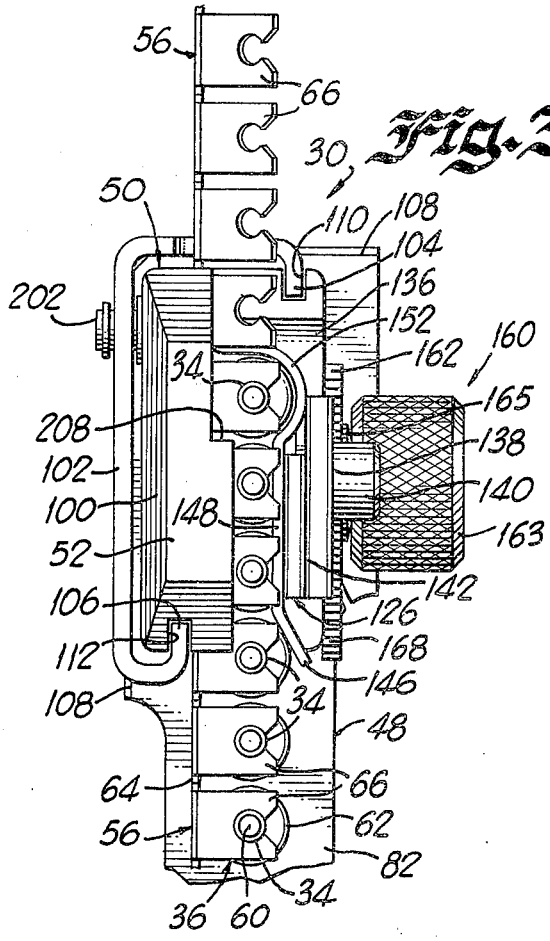
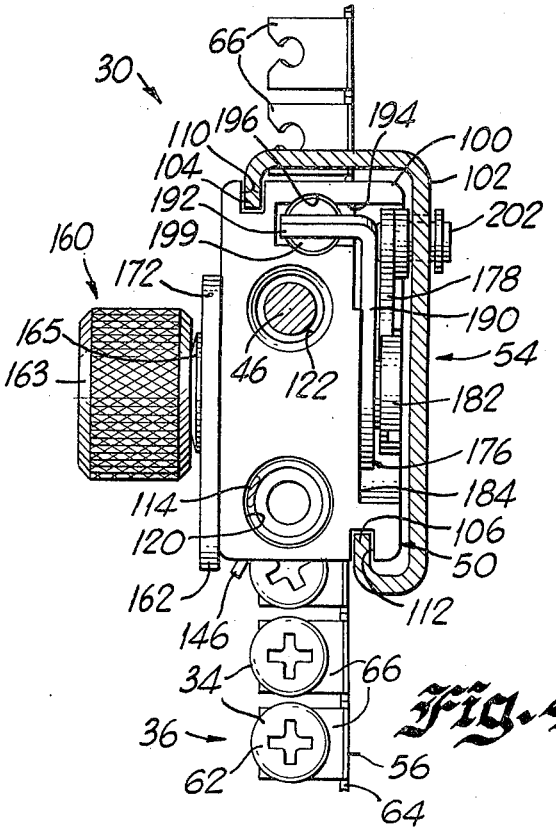
Fig. 4

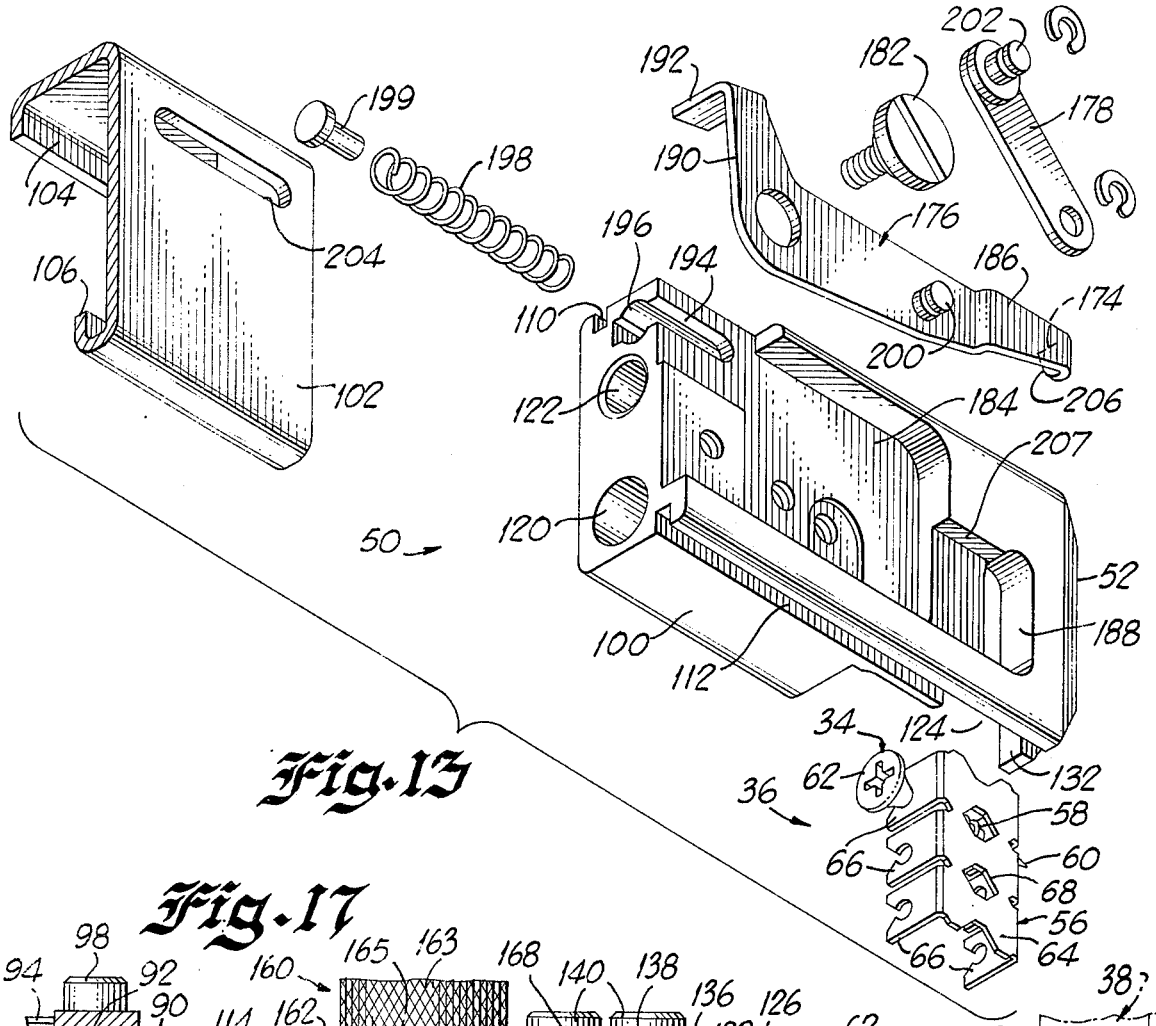
Fig. 13
Fig. 17
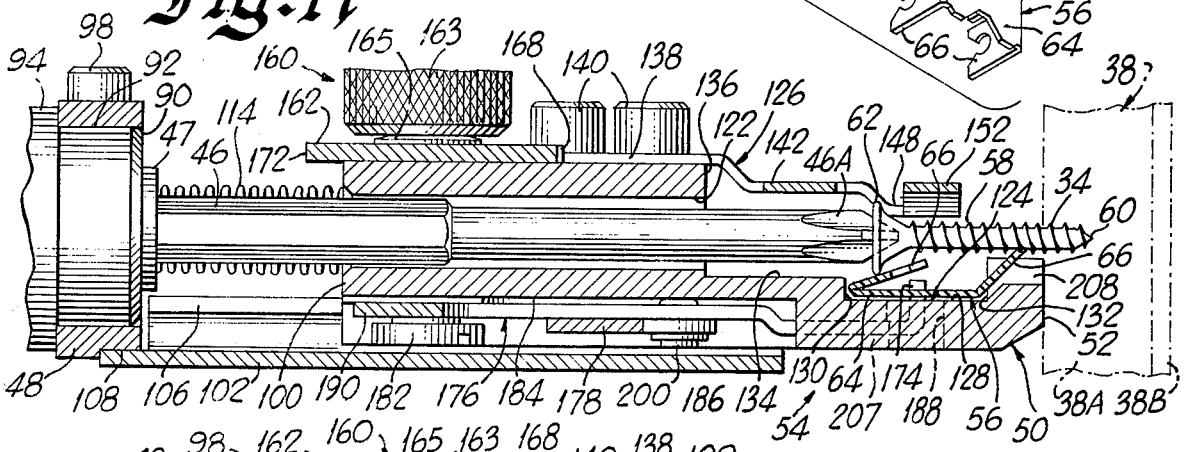
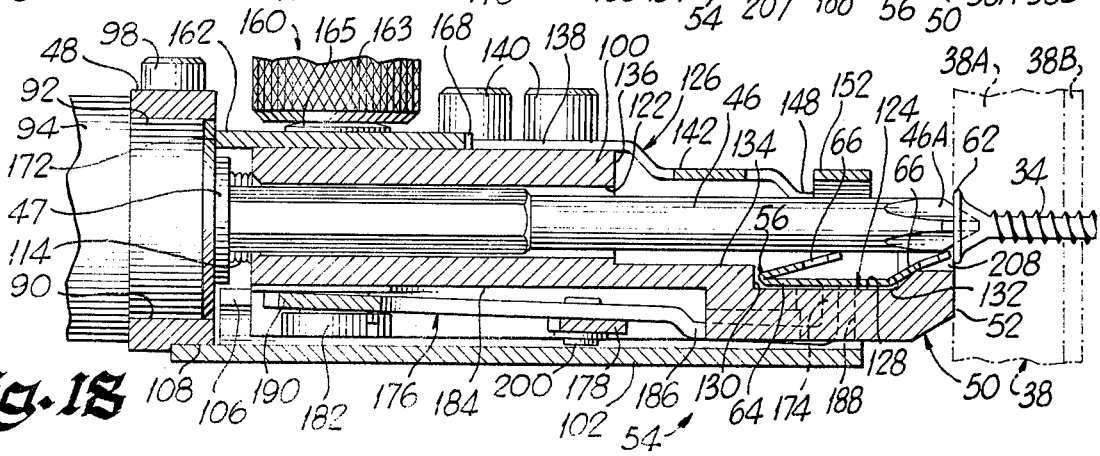
Fig. 18

FASTENER FEED APPARATUS AND METHOD

The present invention relates to improvements in apparatus and methods for feeding fasteners to a fastener driving tool such as a power screwdriver.

Power tools are increasingly used for driving threaded or rotary entry fasteners. As one example, in modern building construction drywall panels, metal panels, or the like are attached to metal studs or other support elements by rotary fasteners driven by power screwdrivers. Typically, a power screwdriver used for this purpose includes a housing with an integral handle and a rotary driving bit extending from the housing. In a conventional fastener driving operation, the bit is engaged with the fastener and the tool is moved toward the panel or other workpiece as the bit rotates to drive the fastener into the workpiece. Individual fasteners are manually positioned for driving, for example by placing the fastener in proximity to a magnetic driver bit or by placing the fastener against the workpiece and thereafter engaging the driver bit with the fastener. Manual handling of individual fasteners is slow, inconvenient and undesirable.

Objects of the present invention are to provide improvements in apparatus and methods for feeding fasteners to a fastener driving tool; to provide a feed assembly particularly useful for feeding fasteners to tools, such as power screwdrivers, of the type which are moved toward a workpiece in order to drive a threaded or rotary entry fastener into the workpiece; to provide a feed assembly utilizing the movement of the tool relative to the workpiece during the driving operation for actuating a fastener feed mechanism; and to provide a feed assembly wherein the feeding mechanism does not interfere with the engagement of the driver bit with a fastener in the drive position. Other objects are to provide fastener feed assemblies which are simple, inexpensive, sturdy and reliable in operation.

In brief, a fastener feed assembly constructed in accordance with the present invention may comprise a base adapted to be mounted on a tool such as a power screwdriver. A nose assembly has a work engaging surface contacting the workpiece during driving of a fastener. The nose assembly is mounted for movement relative to the base so that the base moves in one direction relative to the nose assembly when the tool is pressed toward the work during the fastener driving operation. A return spring moves the base in the opposite direction as the tool is withdrawn from the workpiece after a fastener driving operation. A fastener drive member such as a driver bit is adapted to be connected to the tool and is movable in a drive path from a normal position through the nose assembly and toward the workpiece during the fastener driving operation.

A strip of fasteners extends from a magazine to a feed path in the nose assembly with one fastener of the strip located in a drive position between the drive member and the workpiece. A pawl is engageable with the strip and is movable between a home position and a cocked position. In accordance with the invention, an actuating means is responsive to movement of the base relative to the nose assembly in the one direction for moving the pawl to the cocked position. After driving of a fastener from the drive position, the actuating means is responsive to movement of the base means relative to the nose assembly in the opposite direction for returning the pawl to its home position thereby to advance the next fastener of the strip into the drive position.

The fastener strip comprises a flexible carrier including a base flanked by parallel sets of tabs extending normal to the base and supporting fasteners in generally parallel relation. In accordance with the invention, a tab is deformed by driving of a fastener therefrom in order to move the tab into engagement with a stop defined in the nose assembly. As a result, return movement of the strip during movement of the pawl from the home position to the cocked position is prevented.

In accordance with another feature of the invention, there is provided a lost motion connection between the pawl and its actuating means so that during a fastener driving operation, movement of the pawl to the cocked position is delayed until after secure engagement of the drive member with the fastener to be driven. In addition, in some embodiments of the invention, the actuating means does not operate the pawl to advance the carrier strip until after the drive member is retracted away from the region of the carrier strip.

Another feature of the invention resides in a novel magazine and strip arrrangement for feeding fasteners to the nose assembly. A magazine contains a coil of the fastener strip supported below and generally in the plane of the tool housing and handle. The portion of the strip between the magazine and the nose assembly is twisted through a substantial angle to provide a convenient and easily handled configuration, to avoid interference between the fasteners and workpiece, and to permit relative movement between the magazine and nose assembly.

Briefly, the method of the present invention may comprise supporting a fastener in a drive position aligned with the rotatable bit of a power screwdriver and pushing the screwdriver toward a workpiece in order to engage the bit with the fastener and to drive the fastener into the workpiece. In accordance with the invention, a carrier strip drive pawl is retracted along the strip from its home position to a cocked position during the pushing step. As the screwdriver is withdrawn away from the workpiece, the pawl is advanced to its home position in order to advance the carrier strip and to move an adjacent fastener into the drive position.

The invention together with the above and other objects and advantages may be best understood with reference to the following detailed description of the embodiments of the invention illustrated in the accompanying drawings, wherein:

FIG. 2 is a sectional view taken along the line 2—2 of FIG. 1;

FIG. 3 is a fragmentary, enlarged front elevational view taken from the line 3—3 of FIG. 1;

FIG. 4 is an enlarged sectional view taken along the line 4—4 of FIG. 1;

FIG. 13 is an exploded perspective view on an enlarged scale of parts of the assembly of FIG. 1;

FIG. 17 is a sectional view taken along the line 17—17 of FIG. 14;

FIG. 18 is a sectional view taken along the line 18—18 of FIG. 15;

Figure 1:
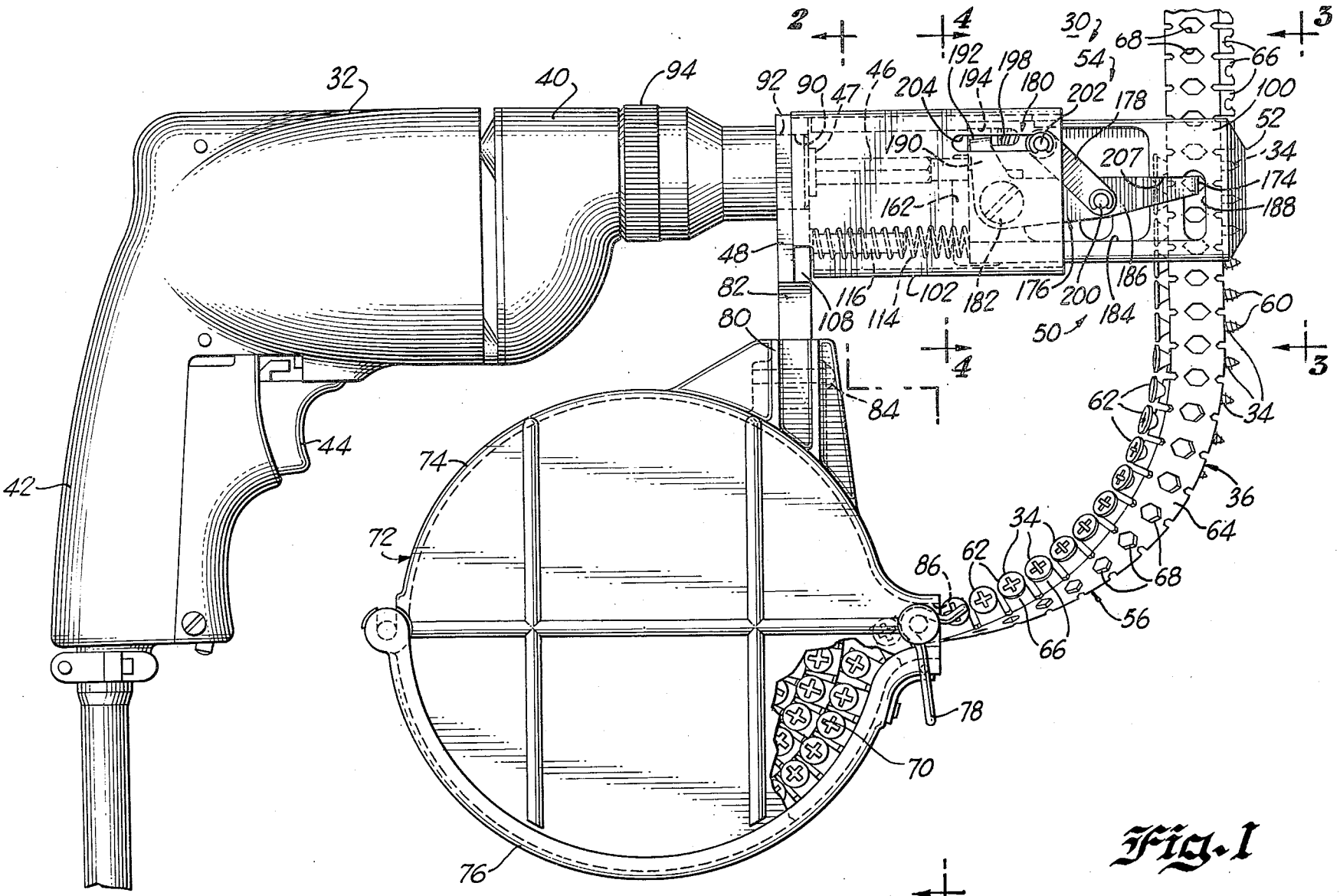
FIG. 1 is a side elevational view of a fastener feed assembly constructed in accordance with the present invention and illustrated in conjunction with a power screwdriver.

With reference now to the drawings, and initially to the embodiment of the invention illustrated in FIGS. 1–18 there is shown a fastener feed assembly designed as a whole by the reference numeral 30 and constructed in accordance with the principles of the present invention. The assembly 30 is mounted on a fastener driving tool 32, and in the illustrated embodiments of the invention, the tool 32 is a power screwdriver. The fastener feed assembly 30 of the present invention serves to feed individual fasteners 34 from a fastener strip 36 into driving position relative to the tool 32 whereupon the fasteners are driven by the tool 32 into a workpiece, such as the workpiece 38 illustrated in FIGS. 14–18.

Principles of the present invention are applicable to the feeding of various types of threaded fasteners or rotary entry fasteners to fastener driving tools of many types. In the illustrated arrangements, the tool 32 is a power screwdriver adapted for the driving of fasteners to attach drywall panels 38A (FIGS. 14–18) to metal studs 38B. The tool includes a housing 40 with a unitary handle portion 42, and a motor (not shown) such as an electric motor or fluid motor is mounted within the housing 40. A trigger 44 adjacent the handle 42 controls the energization of the motor.

Figures 5, 6, 7:
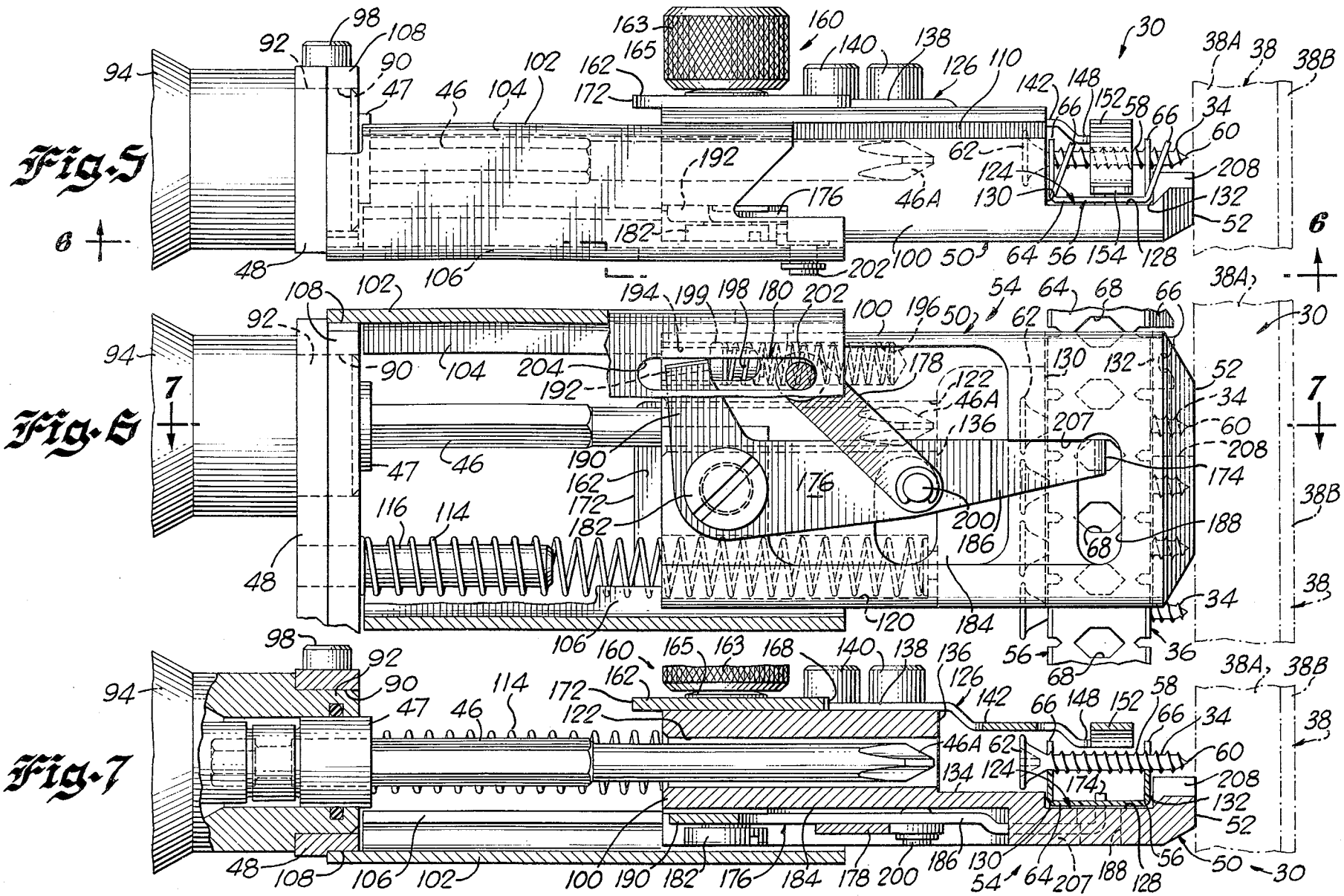
FIG. 5 is an enlarged top plan view of the assembly of FIG. 1.
FIG. 6 is a side view, partly in section, taken along the line 6—6 of FIG. 5.
FIG. 7 is a sectional view taken along the line 7—7 of FIG. 6.

A rotary driving member or bit 46 extends from the housing 40 and includes a tip portion 46A engageable with fasteners 34 for driving the fasteners. Since the tool 32 is intended for the mounting of drywall panels, the tool may be provided with a conventional depth sensitive clutch assembly 47 (FIG. 7). Clutch assembly 47 functions to couple the bit 46 to the tool motor for rotation of the bit in response to pushing of the bit against a fastener. Moreover, the clutch assembly 47 uncouples the bit from the motor when the fastener is driven to a desired depth. One example of a tool of this character provided with a depth sensitive clutch is the Model 2035 screwdriver manufactured and sold by the Black & Decker Manufacturing Company, Towson, Maryland 21204, illustrated in its catalog No. PE-3 (7/73 Supplement) BP.

In the use of a tool for driving threaded fasteners, the tool drive member or bit is engaged with a fastener to be driven, and then is pressed against the workpiece while the bit rotates the fastener in order to drive the fastener into the workpiece. In accordance with an important feature of the present invention, the relative movement of the tool with respect to the workpiece is utilized to feed successive fasteners 34 from the strip 36 into drive position in alignment with the bit 46.

In general, the fastener feed assembly 30 includes a base member 48 adapted to be mounted to the tool 32 thereby to support the assembly 30 in position on the tool. The assembly also includes a nose assembly 50 having a workpiece engaging surface 52 pressed against the workpiece 38 during the fastener driving operation. The base 48 and nose assembly 50 are movable relative to one another as the tool 32 is moved toward and then withdrawn from the workpiece. In accordance with the invention, there is provided a feed mechanism designated as a whole by the reference numeral 54 and operated in response to relative movement of the nose assembly 50 and base member 48 for incrementally advancing the fastener strip 36 in order to locate individual fasteners in sequence for driving by the tool 32.

In the illustrated arrangement, each fastener 34 includes a shank portion 58, at least a portion of which is threaded, a tip 60 at the entry end of the shank 58, and a head 62 at the opposite end of the shank. The head 62 is provided with a drive slot structure complimentary with the tip 46A of the bit 46 in accordance with known practice. Rotary entry fasteners or threaded fasteners are provided in many forms, and the present invention can be used with advantage in feeding many types.

With reference now to the fastener strip 36, in the illustrated embodiments of the invention the strip 36 is of the type disclosed in U.S. Pat. No. 3,438,487, to which reference may be had for details of its structure. The strip 36 includes a carrier member 56 in the form of an elongated strip of flexible plastic material having a generally channel-shaped cross section. A base or web portion 64 is continuous throughout the length of the strip 36 and tabs 66 extend from the opposite sides of the base 64 in opposed pairs. Each tab 66 is provided with a fastener holding slot structure and opposed pairs of the tabs 66 frictionally retain a fastener with its shank portion 58 parallel to the plane of the adjacent carrier base portion 64 and with its major longitudinal axis generally perpendicular to the adjacent segment of the fastener strip 36. The base portion 64 is provided with a series of openings 68, each being offset longitudinally on the strip from the shank portion 58 of an adjacent fastener 34. The fasteners 34 can be collated on the carrier 56 using any suitable means such as, for example, the collating machine shown in U.S. Pat. No. 3,538,673. The strip 36 can be formed in a running length, or in a coil as shown in U.S. Pat. No. 3,450,255.

In accordance with the present invention, the fastener strip 36 is formed in a coil 70 and is supplied to the nose assembly 50 from a magazine 72 disposed conveniently with respect to the tool 32 and feed assembly 30. The fastener strip 36 is twisted through a substantial angle, ninety degrees in the illustrated embodiment, in that portion of the strip extending between the magazine 72 and the nose assembly 50 of the feed assembly 30. As illustrated in FIG. 1, the feed assembly 30 is generally in line with the housing 40 of the tool 32 and the handle 42 is angularly related to the common principal axis of the housing and feed assembly. In accordance with the invention, the magazine 72 is supported within the angle included by the handle 42 and housing 40 and moreover lies generally in the same plane as the plane defined by the housing 40 and handle 42. As a result, the magazine 72 does not protrude in an awkward manner to the sides of the tool 32, and the weight of the magazine 72 and coil 70 is suspended directly beneath the major axis of the tool 32 and assembly 30 so that there is no tendency for the tool to twist in the hand of the operator. Twisting of the strip prevents interference between the strip and the workpiece, and permits the strip to flex as the tool and magazine are moved relative to the nose assembly.

Referring more specifically to the structure of the magazine 72, the magazine comprises a housing 74 preferably formed of a relatively lightweight yet strong material, such as a suitable plastic or the like. The housing 74 is generally circular in outline so as to enclose the coil 70 of the fastener strip 36. A generally semicircular portion of the peripheral wall of housing 74 comprises a hinged door 76 releasably latched in the illustrated closed position by a latch assembly 78. A socket 80 is formed on the housing 74 in order to mount the magazine 72 on a downwardly projecting leg 82 of the base member 48 of the feed assembly 30, as by means of a screw fastener 84. When the coil 70 of the fastener strip 36 is initially mounted in the magazine 72, the outer, leading end of the strip is fed out of the magazine through a feed opening 86 defined in the housing 74. The lead end of the strip 36 is twisted through ninety degrees and is fed into the nose assembly 50.

Proceeding to a more detailed description of the structure of the fastener feed assembly 30, the base member 48 is in the form of a block-like body including a circular opening 90 for attaching the base 48 to a projecting boss 92 of an adaptor member or clutch housing 94 carried by the housing 40 of the tool 32. A slot 96 (FIGS. 2 and 12) extends between the opening 90 and the exterior edge of the base 48, and a screw member 98 is tightened in order firmly to hold the base 48 in position on the member 94. The magazine support leg 82 preferably is an integral part of the base member 48 and the magazine 72 as well as the base member 48 are held in a fixed position relative to the tool housing 40.

The major structural component of the nose assembly 50 is a nose block 100. The block 100 is mounted for reciprocal movement relative to the base member 48 by means of a slide member 102. In section (see, for example, FIGS. 2–4 and 13) the slide member 102 is somewhat J-shaped or C-shaped, and terminates in a pair of inwardly directed slide flanges 104 and 106. One end of the slide member 102 is secured to the base member 48. More specifically, the base member 48 includes a recessed mounting surface 108 on two adjacent edge walls thereof for receiving the end of the slide member 102, and the slide member 102 is suitably fastened in any desired manner as by welding in place.

In order to support the nose block 100 on the slide member 102, the block 100 is provided with a pair of slide slots 110 and 112 extending throughout the length of the block into which the slide flanges 104 and 106 respectively are received. When the block 100 is slidingly positioned in the slide member 102, the block is free to move toward and away from the base member 48 and is constrained against movement in other directions. Due to its partly rectangular, generally J or C-shape, the slide member covers and protects the nose assembly 50.

A return spring 114 (FIGS. 1, 6 and 12) is held in compression between the base member 48 and the nose block 100 in order to urge the nose block 100 toward its outermost position (FIGS. 1 and 6). A spring retaining pin 116 is mounted on the base member 48 and extends toward the nose block 100. The spring 114 and pin 116 are slidably received in an aligned opening 120 in the block 100 of sufficient length to permit reciprocal movement of the block 100 relative to the base member 48.

The drive member or bit 46 in accordance with conventional practice is located generally in line with the major axis of the tool housing 40. The bit is concentric with and extends from the adapter member or clutch housing 94 fixed to the housing 40, and thus extends through the opening 90 of the base member 48 toward the block 100 of the nose assembly 50. The block 100 is provided with an opening or drive channel 122 receiving the bit 46 and permitting both longitudinal and rotational movement of the bit with respect to the block 100.

In order to permit feeding of the fastener strip 36 through the nose assembly 50 for registration of the fasteners 34 in sequence with the bit 46, a feed path 124 is defined by the nose assembly 50 and more specifically by the nose block 100 and by a guide member 126 mounted on the block 100. As best appears in FIGS. 5 and 7, the feed path 124 comprises a recess or opening extending through the block 100 in a direction transverse to the direction of movement of the block.

The path 124 is defined in part by a base wall 128 flanked by a pair of side walls 130 and 132, these walls being shaped to slidingly receive the base portion 64 and the tabs 66 of the strip carrier member 56. In addition, the path 124 is further defined by a pair of walls 134 and 136 (FIGS. 10 and 12) permitting movement of the head portions 62 of fasteners 34 into the nose assembly 50. Although in the illustrated arrangement the wall 136 is spaced substantially from the fastener heads 62, it will be understood that if fasteners of greater length are used, the portion of the feed path 124 defined by walls 134 and 136 permits movement of the fasteners into the nose assembly 50. The workpiece engaging surface 52 of the nose assembly 50 is defined on the block 100, and specifically on the outermost portion of the block opposite the wall 132. Preferably the fasteners 34 are mounted in the carrier 56 in such a way that prior to the drive operation the tips 60 are located adjacent to but do not extend beyond the workpiece engaging surface 52.

Guide member 126 cooperates with block 100 in defining the feed path 124 and functions to guide the fastener strip 36 into the feed path and to retain the strip in the path. The guide member 126 includes a foot portion 138 fastened to the block 100 in any suitable manner as by a pair of cap screws 140. A guard portion 142 of the guide member 126 extends over the feed path 124 and serves to cover the region through which the bit 46 moves during a fastener driving operation. A guard flange 144 extends toward the wall 134 (FIG. 10) and encloses the head 62 of a fastener 34 in the drive position.

Opposite the foot portion 138, the guide member 126 includes a sloping entry guide flange 146 leading to an elongated guide surface 148 opposed to the wall 128 of the block 100. A can best be seen in FIGS. 3 and 9, the fastener strip 36 is guided into the feed path 124 by the flange 146. The guide surface portion 148 enters between the opposed rows of tabs 66 of the carrier 56 in order to cooperate in holding the carrier in position. Movement of the carrier 56 away from the wall 128 is prevented by engagement of the guide surface 148 with the shank portions 58 of the fasteners 34.

Upon insertion of the fastener strip 36 into the feed path 124, a first fastener 34 of the strip is located in a drive position in line with the bit 46 in the nose assembly 50. A generally rounded segment 152 of the terminal portion of the guide member 126 surrounds the drive position and provides room for movement of the head 62 of a fastener from the block 100 and into the workpiece 38. Opposite the entry guide flange 146, the guide member 126 also includes an exit guide member 154 for guiding the carrier strip 36 out of the feed path 124. The exit guide member 154 is of particular importance in maintaining the strip in position as the last few fasteners of the strip are driven.

Once the fastener strip 36 has been initially loaded into the feed path 124 with a fastener 34 located in the drive position 150, a fastener driving operation can be carried out. The nose assembly 50 is placed against the workpiece 38 with the workpiece engaging surface 52 abutting the workpiece. The tool 32 is then pressed toward the workpiece to advance the bit 46 through the opening 122 in the nose block 100. Movement of the tool toward the workpiece continues until the tip 46A engages the head 62 of the fasteners 34. The fastener is forced by the bit against the surface of the workpiece.

Figure 16:
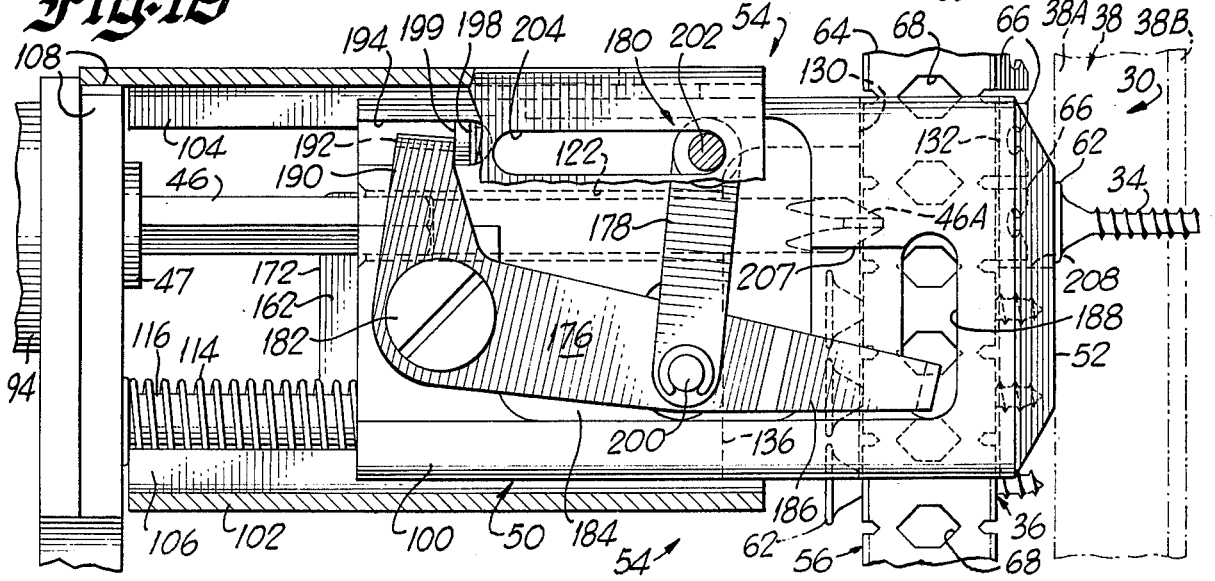
FIG. 16 is a view similar to FIG. 6 illustrating the assembly of an intermediate point during withdrawal of the tool.
Figure 19:
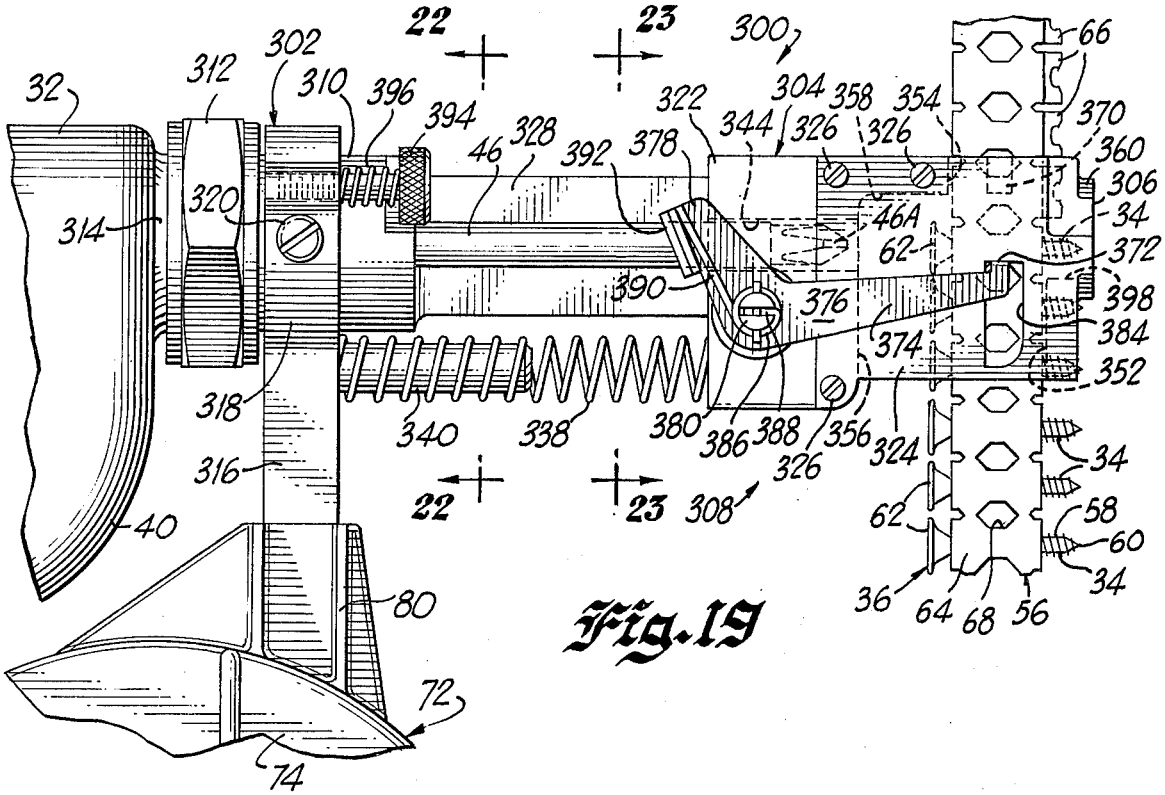
FIG. 19 is a fragmentary side elevational view of a fastener feed assembly comprising an alternative embodiment of the present invention.

If a depth sensitive clutch is provided for the tool 32, the force resulting from pushing the bit and fastener against the workpiece causes the clutch to become engaged so that the motor of the tool 32 is coupled to the bit 46 in order to rotate the bit. The tool 32 is pushed further toward the workpiece and as a result the fastener is driven into the workpiece. When the fastener is fully driven as illustrated in FIG. 16, further movement of the tool toward the workpiece is prevented. The reduction in axial force applied to the bit 46 causes the depth sensitive clutch to become disengaged, and thereafter the tool 32 is withdrawn away from the workpiece.

The feed assembly 30 can also be used with tools not provided with clutch mechanisms. In this case the movement of the tool relative to the workpiece is the same, and the bit may either be rotated continuously, or alternatively the rotation of the bit may be selectively controlled by other means as by manual operation of the trigger 44.

Figures 8, 9, 10, 11:
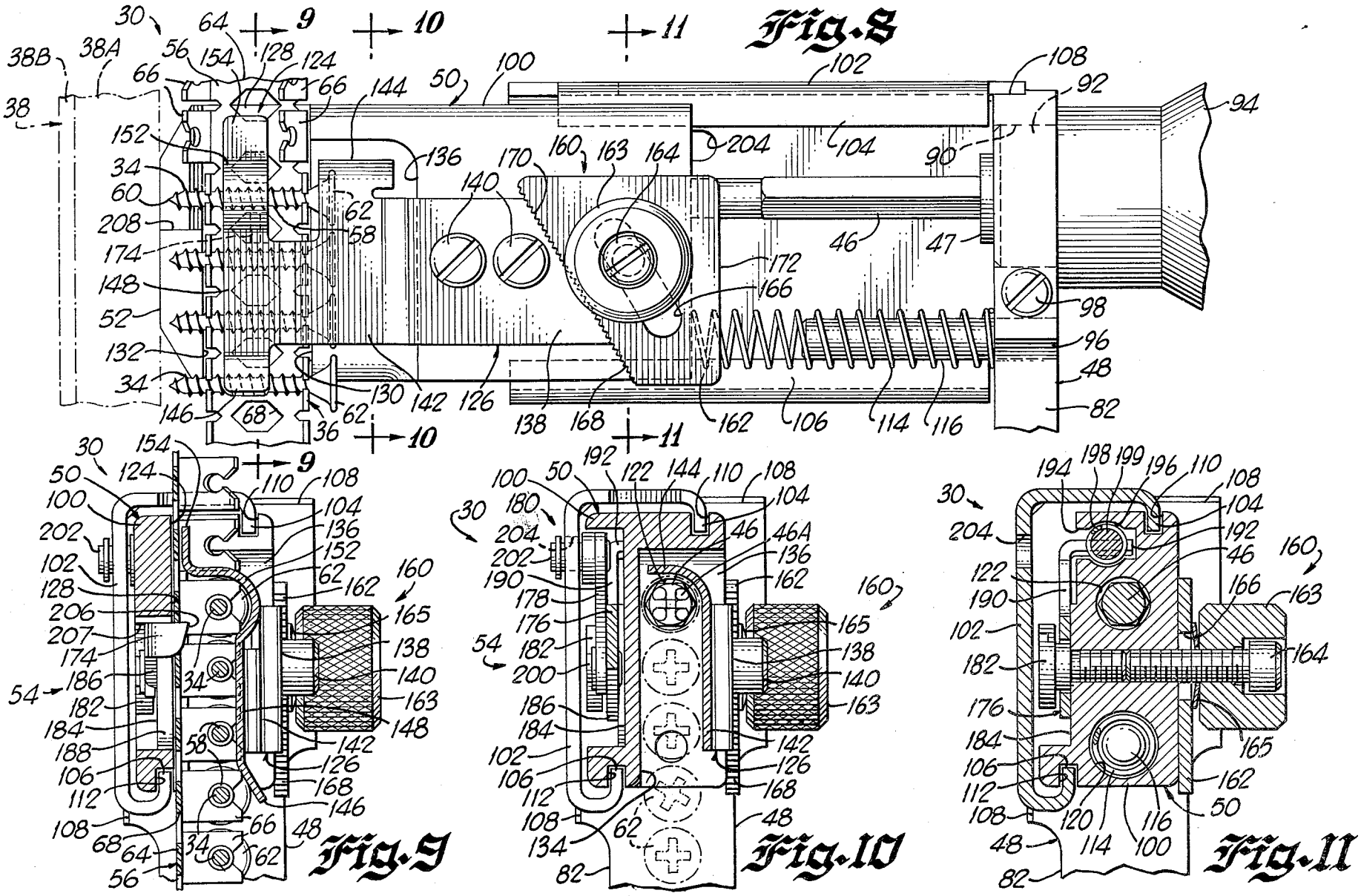
FIG. 8 is a side elevational view on an enlarged scale of the assembly of FIG. 1 and illustrating the side opposite to that shown in FIGS. 1 and 6.
FIG. 9 is a sectional view taken along the line 9—9 of FIG. 8.
FIG. 10 is a sectional view taken along the line 10—10 of FIG. 8.
FIG. 11 is a sectional view taken along the line 11—11 of FIG. 8.
Figure 12:
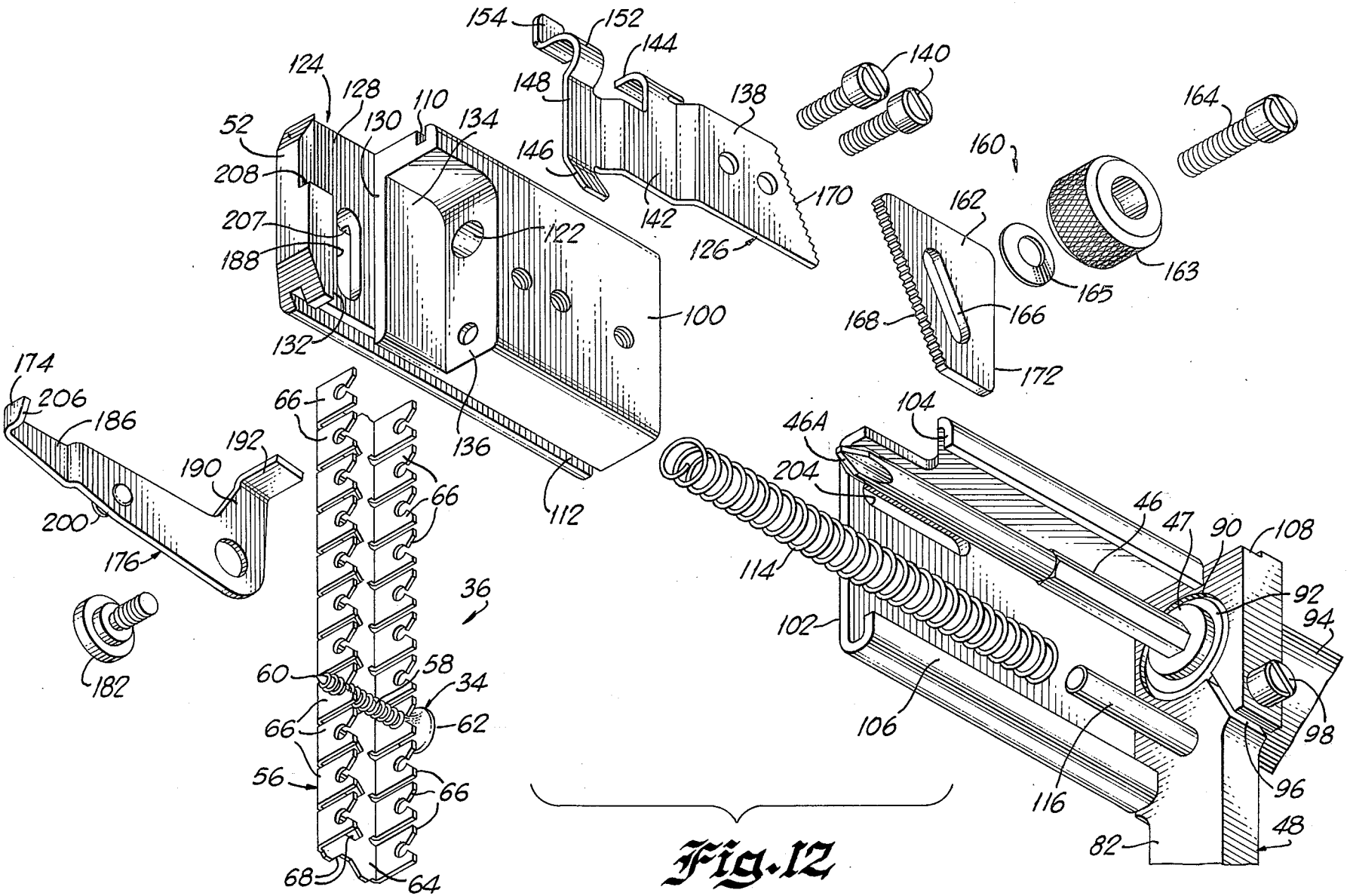
FIG. 12 is an exploded perspective view on an enlarged scale of parts of the assembly of FIG. 1.
Figure 14:
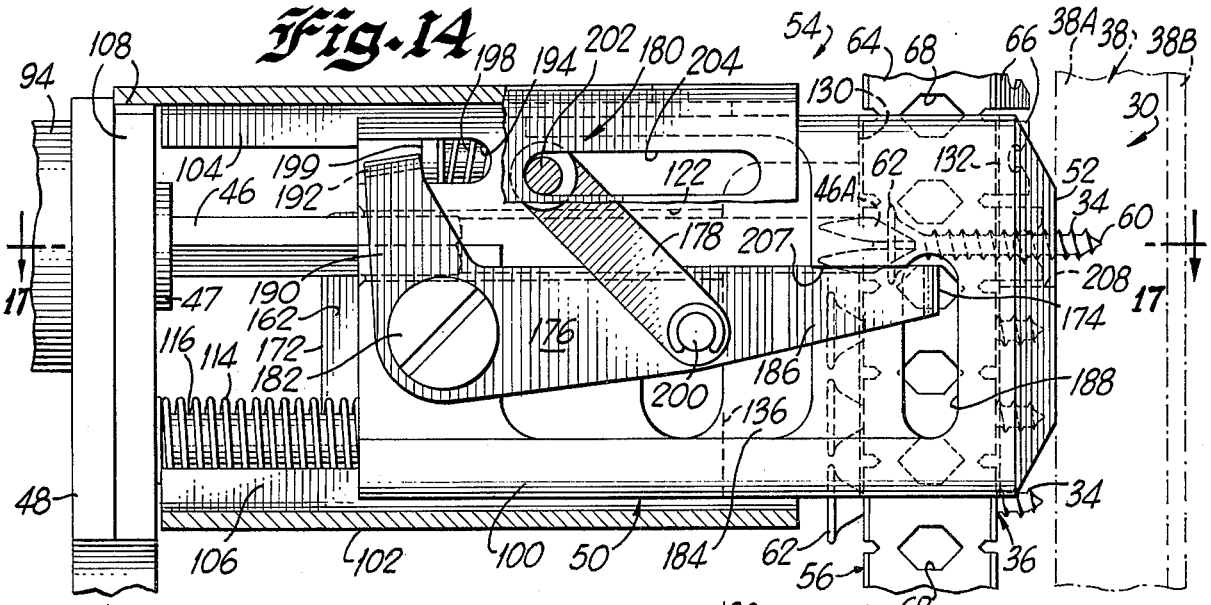
FIG. 14 is a view similar to FIG. 6 illustrating the assembly at an intermediate condition during driving of a fastener.

The depth to which a fastener 34 is driven during the driving operation is determined by an adjustable depth stop assembly generally designated as 160 (FIGS. 8, 11 and 12). An adjustable stop plate 162 is held against one side of the nose block 100 by means of a releasable adjustment nut 163 carried by a screw 164 extending through an inclined slot 166 in the plate 162. A spring washer 165 resiliently maintains the plate 162 against the block 100. The plate 162 includes an inclined, serrated edge 168 adapted to interfit with a correspondingly inclined and serrated edge 170 of the base pad portion 138 of guide member 126. Opposite the serrated edge, the plate 162 includes a stop edge 172 directed toward the base member 48.

By loosening the nut 164 and positioning the plate 162, the position of the edge 172 is adjusted to limit the maximum movement of the nose assembly 50 toward the base member 48. In the illustrated position, the stop edge 172 engages the base member 48 when the bit 46 has moved sufficiently to drive the fastener 34 to a flush position into the workpiece 38. The depth stop assembly 160 may be adjusted from its illustrated position to provide for any desired countersink depth of the fasteners 34.

During the fastener driving operation, it can be seen that the base member 48 and nose assembly 50 are moved toward one another during the drive stroke and are moved away from one another by the return spring 114 during the withdrawing motion. In accordance with an important feature of the present invention, this relative movement during the fastener driving operation is used to operate the feed mechanism 54 in order to advance the fastener strip 36 in increments through the feed path 124.

In general, the feed mechanism 54 includes a feed pawl 174 associated with a pawl lever 176. A drive link 178 causes the pawl 174 to move between a home position (FIGS. 6, 9 and 14) and a cocked position (FIGS. 15 and 16) as the base member 48 is moved toward the nose assembly 50. Conversely, when the base member 48 moves away from the nose assembly 50, the pawl 174 is returned in the opposite direction to the home position in order to advance the fastener strip 36 through one increment of movement along the feed path 124. A lost motion connection generally designated as 180 is associated with the drive link 178 in accordance with the invention in order to insure that operation of the feed mechanism 54 does not interfere with the driving of a fastener 34 by the bit 46.

A shoulder screw 182 (FIGS. 11 and 14–18) pivotally supports the pawl lever 176 on the nose block 100. The lever 176 and screw 182 are located in a recess 184 in the side wall of block 100 to achieve a compact configuration and to make it possible to locate the feed mechanism 54 in a protected position under the wall of the slide member 102.

The pawl lever 176 includes a leg 186 extending from the pivot screw 182 toward the feed path 124. The terminal end of the leg 186 is bent in a transverse direction to form the pawl 174. A slot 188 is provided in the block 100 and extends to the wall 128 in order to permit engagement of the pawl with the base portion 64 of the carrier 56.

In order to bias the pawl 174 to the home position illustrated in FIG. 6, the lever includes a second leg 190 terminating in transverse a spring retainer portion 192. The portion 192 extends through a slot 194 and into a spring cavity 196 formed in the nose block 10. A pawl return spring 198 carries a pusher element 199 and is held in compression against the portion 192 in order continuously to bias the lever 176 in a counterclockwise direction as viewed in FIGS. 14–16.

One end of the drive link 178 is pivotally connected to a point along the length of the leg 186 of the pawl lever 176 by a pivot pin 200. The opposite end of the link 178 is pivotally and slidably interconnected by a pivot pin 202 with a slot 204 formed in the slide member 102. Consequently, when the base member 48 and thus the slide member 102 move toward the nosepiece assembly 50 from the position illustrated in FIG. 14 to the position illustrated in FIG. 15, the pawl lever 176 is rotated against the force applied by the spring 198 to move the pawl from its home position to the cocked position illustrated in FIGS. 15 and 16.

As best seen in FIG. 9, the pawl 174 is provided with a cam surface 206 so that the pawl 174 can move toward the cocked position without driving the fastener strip 36 in the reverse direction. Substantial clearance exists beneath the head of the shoulder screw 182 (FIG. 11) to permit movement of the leg 186 away from the nose block 100. Thus, during cocking movement, the pawl 174 is retracted by the cam surface 206 out of the plane of the carrier base portion 64.

After driving of a fastener 34 when the base member 48 and slide 102 move away from the nose assembly 50, the pawl 174 moves in the opposite direction from the cocked position of FIG. 16 to the home position of FIG. 6. This movement is occassioned by the operation of the spring 198. In the cocked position, the pawl 174 may or may not be aligned with one of the openings 68 in the carrier 56 because the cocked position varies with the setting of the adjustable depth stop assembly 160. During movement from the cocked position to the home position, the pawl registers with an opening 68. As can be seen in FIG. 11, the pawl return spring 198 also biases the pawl lever 176 in a direction to urge the pawl 174 into the opening 68. During its return movement, the pawl advances the fastener strip 36 so that a next sequential fastener 34 is positioned in the drive position. In the home position, leg 186 seats against a shoulder 207 of nose block 100 (FIGS. 6 and 13).

In accordance with a feature of the invention, the lost motion connection 180 prevents cocking of the pawl until after the bit 46 engages and begins to drive a fastener 34. More specifically, during the initial portion of the driving stroke as the slide member 102 moves relative to the nose assembly 50 from the position illustrated in FIG. 6 to the position illustrated in FIG. 14, the pivot pin 202 merely slides along the slot 204. Thus, during this segment of movement, no rotation is imparted to the pawl lever 176. As the slide member 102 moves to the position illustrated in FIG. 14, the bit 46 securely engages and begins to drive the fastener 34. It is only after movement beyond the position of FIG. 14, when the pin 202 reaches the end of the slot 204, that the pawl 174 begins to move away from its home position. At this point, operation of the feed mechanism does not interfere with driving of the fastener.

Figure 15:
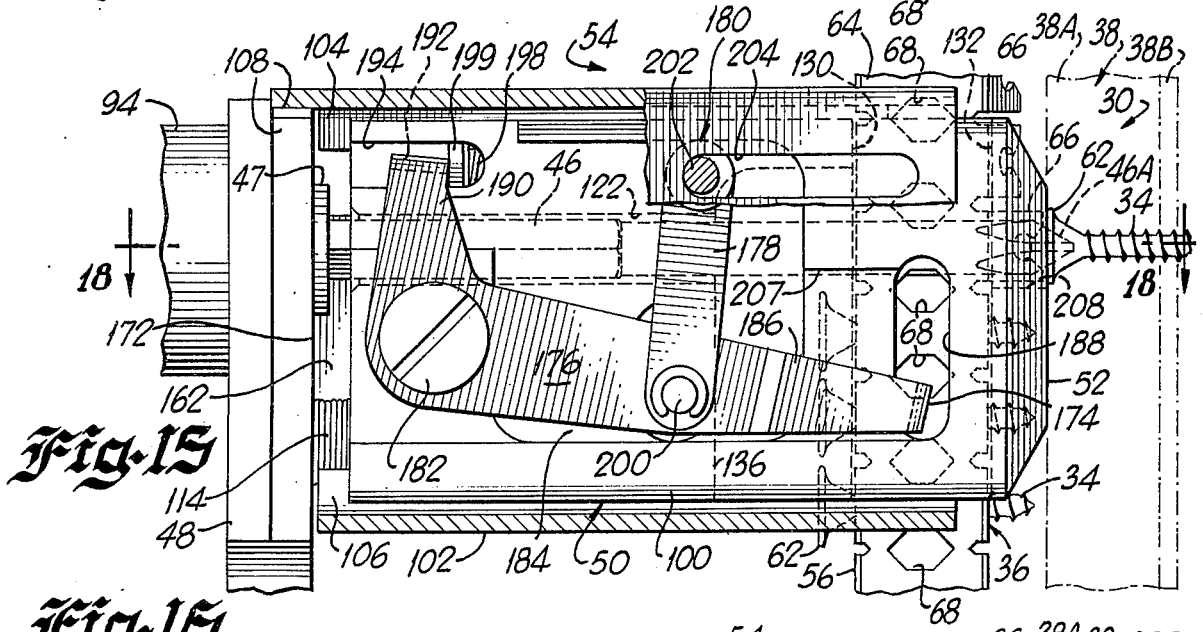
FIG. 15 is a view similr to FIG. 6 illustrating the assembly at the completion of a fastener driving stroke.

Also in accordance with a feature of the invention, the pawl 174 is not retracted from its cocked position to the home position until after the bit 46 has been moved substantially clear of the carrier 56 in the feed path 124. More specifically, as illustrated in FIGS. 15 and 16, when the pawl 174 has been moved to its cocked position, the link 178 is in an overcenter or locked position. In this position, the link 178 forms an angle of nearly ninety degrees or more with the leg 186 and the spring 198 is unable to pivot the pawl lever 176 in a counterclockwise direction as illustrated in FIG. 15. Thus, during the first portion of movement of the base member 48 and slide 102 away from the nose assembly 50 — i.e. movement from the position of FIG. 15 to the position of FIG. 16 — the pivot pin 202 simply moves in the slot 204. As the bit 46 moves clear of the carrier 56, the pin 202 reaches the end of the slot 204 and the link 178 is moved back overcenter thus unlocking the lever 176 and permitting the spring 198 to pivot the lever.

One advantage of the feed mechanism 54 of the present invention is that no frictional retaining device, return pawl, or the like is required to prevent reverse movement of the fastener strip 36 during cocking movement of the pawl. In part, this advantage arises from the fact that the pawl lever 176 is mounted somewhat loosely by shoulder screw 182 and biased relatively lightly toward carrier strip 56 by spring 198. This arrangement permits the pawl 174 readily to ride out of the openings 68 and over the surface of the base portion 64 of the carrier 56. In addition, in accordance with a feature of the present invention, a part of the fastener strip 36 is itself deformed during the drive operation in order to provide a stop against reverse movement.

More specifically, as can be seen in FIG. 17, as a fastener 34 is driven into the workpiece by the bit 46, the tabs 66 are bent to an angular position relative to the base portion 64. The nose block 100 is stepped along the workpiece engaging surface 52 to provide a stop shoulder 208 shown in FIGS. 3 and 17. This shoulder is disposed adjacent the edge of one of the tabs 66 supporting a fastener 34 in the drive position. When this tab is deformed, it overlies the stop surface 208 and effectively prevents movement of the fastener strip in the reverse direction through the feed path 124.

Referring now to FIGS. 19–27, there is illustrated a fastener feed assembly generally designated as 300 and compring an alternative embodiment of the present invention. Feed assembly 300 is mounted on fastener driving tool 32 and serves to feed individual fasteners 34 from fastener strip 36 for driving of the fasteners into a workpiece 38 (FIGS. 26 and 27) consisting in the illustrated arrangement of a drywall panel 38A and a metal stud 38B. Since the tool 32, fasteners 34, strip 36 and magazine 72 have been described above in connection with the embodiment of FIGS. 1–18, identical reference numerals are used for identical parts in FIGS. 19–27 and further description is unnecessary.

In general, the fastener feed assembly 300 includes a base assembly 302 adapted to be mounted to the tool 32, as well as a nose assembly 304 having a workpiece engaging surface 306 engageable with the workpiece 38 during the fastener driving operation. The base assembly 302 and nose assembly 304 are movable relative to one another as the tool 32 is moved toward and then withdrawn from the workpiece. In accordance with the invention, there is provided a feed mechanism generally designated by the reference numeral 308 and operated in response to relative movement of the nose assembly 304 and base assembly 302 for advancing the fastener strip 36 in increments in order to locate individual fasteners in sequence for driving by the tool 32.

Proceeding to a more detailed description of the fastener feed assembly 300, the base assembly includes a generally cylindrical clutch housing portion 310 attached to the housing 40 of tool 32 by means of a coupling nut 312 threaded over a threaded boss 314 carried by the tool housing. A magazine support element 316 includes a collar 318 encircling the housing 310 and is held firmly in position by means of a pair of screws 320 threaded through the collar 318 against the housing 310.

Figure 20:
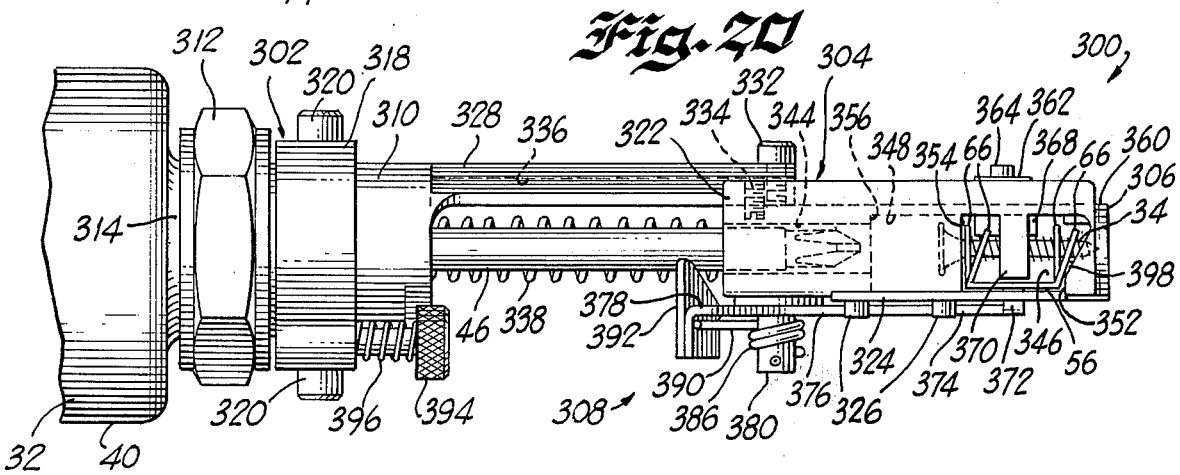
FIG. 20 is a top plan view of the assembly of FIG. 19.
Figure 21:
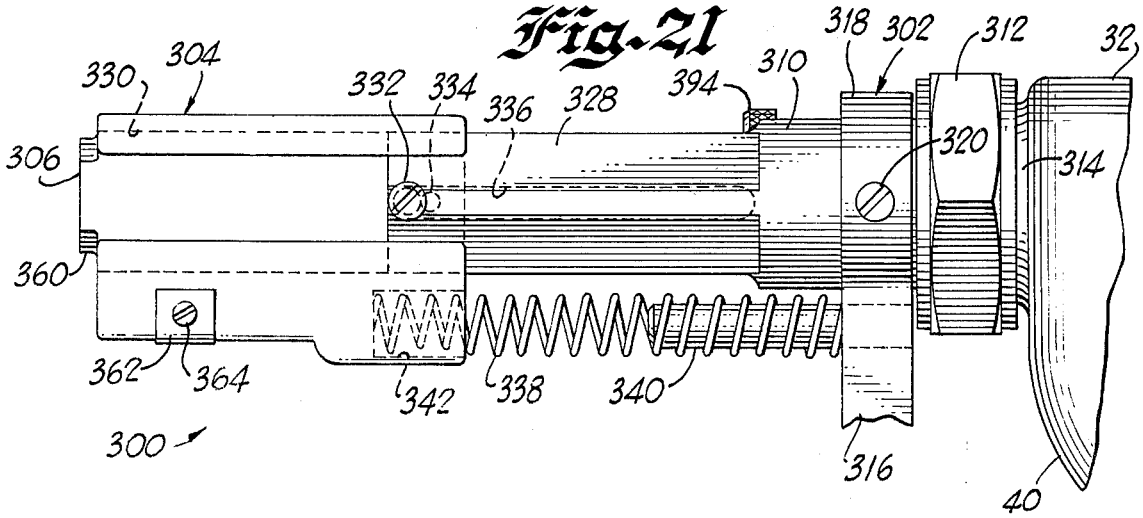
FIG. 21 is a side elevational view illustrating the side of the assembly opposite to that shown in FIG. 19.
Figure 22:
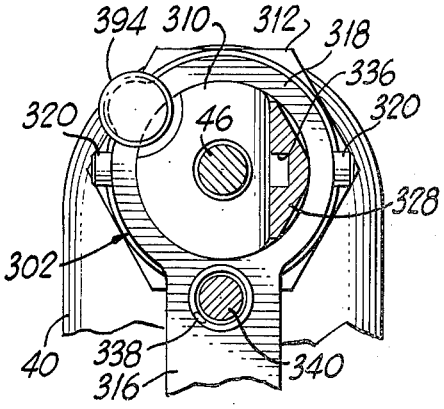
FIG. 22 is a sectional view taken along the line 22—22 of FIG. 19.
Figure 23:
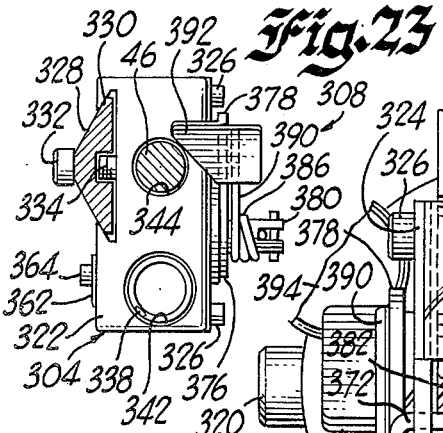
FIG. 23 is a sectional view taken along the line 23—23 of FIG. 19.
Figure 24:
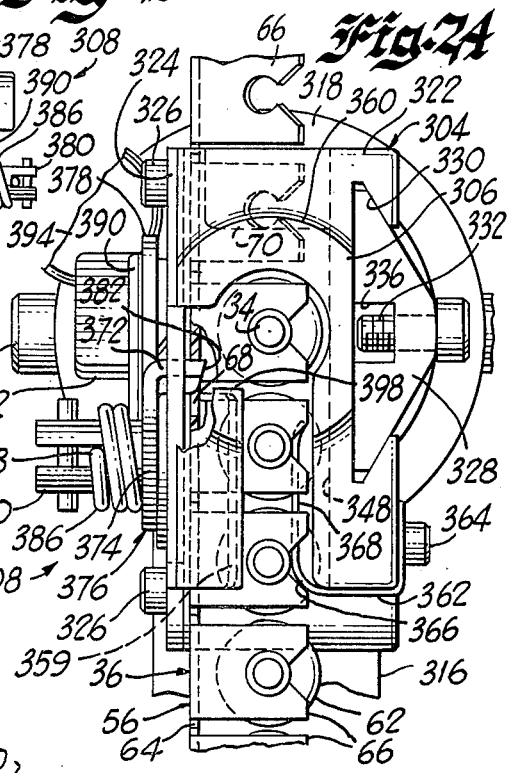
FIG. 24 is a front elevational view of the assembly of FIG. 19 on an enlarged scale.

Nose assembly 304 includes a nose block 322 against one side of which a cover plate 324 is attached, as by screws 326, or alternatively by welding or otherwise. The nose assembly 304 is mounted for reciprocal movement relative to the base assembly 302 by means of a slide member 328. The slide member 328 is formed as an integral extension of housing 310 and is slidably received in a slide track 330 formed in nose block 322. Block 322 is captured on the slide member 328 by a first abutment screw 332 carried near the outer end of the slide member 328, and a second abutment screw 334 supported by the nose block 322. Slide member 328 includes a channel 336 in which the abutments 332 and 334 are located, and engagement of the abutments with one another, as illustrated in FIG. 20, prevents movement of the block 322 off of the slide member 328.

A return spring 338 is held in compression between the base assembly 302 and the nose assembly 304 in order to urge the nose assembly 304 toward its outermost position. A spring retaining pin 340 is mounted on the magazine support element 316 of the base assembly 302 and extends toward the nose assembly 304. The spring 338 and pin 340 are slidably received in an aligned opening 342 in the nose block 322, the opening being of sufficient depth to permit reciprocal movement of the nose assembly 304 relative to the base assembly 302.

The drive member or bit 46 is concentric with and extends through the clutch housing 310 toward the nose assembly 304. The nose block 322 is provided with an opening or drive channel 344 receiving the bit 46 and permitting both longitudinal and rotational movement of the bit with respect to the block 322.

Figure 25:
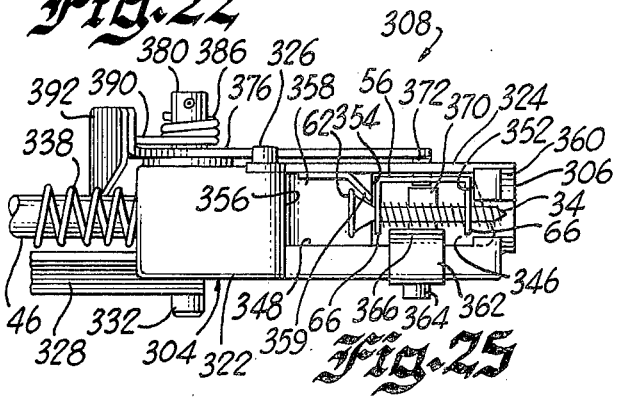
FIG. 25 is a bottom view of the assembly of FIG. 19.

To permit feeding of fastener strip 36 through the nose assembly 304 for registration of fasteners 34 in sequence with the bit 46, a feed path 346 is defined by the nose assembly 304. The feed path 346 is defined between the inner wall of the cover plate 324 and a parallel, opposite wall 348 of the block 322. Tabs 66 at opposite sides of the carrier 56 move between opposed walls 352 and 354. The feed path 346 is further defined by a pair of walls 356 and 358 defining a space for movement of the head portions 62 of fasteners 34 into the nose assembly 304. A guide plate 359 holds strip 36 against wall 352 at the entrance end of the feed path (FIG. 25). The workpiece engaging surface 306 of the nose assembly 304 is defined on the block 322 opposite the wall 352, and specifically on the end of a cylindrical locating boss portion 360 of the nose block 322. Preferably, prior to being driven by the bit 46, the tips 60 of the fasteners 34 do not extend beyond the work engaging surface 306.

In order to guard the region through which the bit 46 moves to drive a fastener 34 from the strip 36, the feed path 346 is largely covered by the nose block 322 and cover plate 324. In order to guide the strip 36 into the feed path 346, a spring guide member 362 is mounted to the nose block 322, as by means of a screw 364. The spring guide member includes a rounded entry surface 366 facilitating the entry of the strip 36 into the feed path 346. The spring member also includes a planar portion 368 engageable with the shank portions 58 of the fasteners 34 for holding the carrier 56 between the wall 352 and plate 359, and against the inner side of the cover plate 324.

At the exit end of the feed path 346, a retaining protuberance 370 extends from the wall 348 toward the cover plate 324 as can be seen in FIGS. 20 and 25. The web portion 64 of the carrier 56 is sandwiched between the protuberance 370 and the cover plate 324 in order to guide the carrier 56 from the nose assembly 304. Protuberance 370 is of particular advantage in maintaining the strip in position as the last few fasteners of the strip are driven.

The strip 34 after being loaded into the magazine 72 is fed into the nose assembly 304 by inserting the leading end of the strip over the guide surface 366 and into the feed path 346. A first fastener 34 of the strip is located in a drive position in line with the bit 46 and its drive channel 344. Once the fastener strip 36 has been initially loaded into the feed path with a fastener 34 located in the drive position, a fastener driving operation can be carried out. The nose assembly 304 is placed against the workpiece 38 with the workpiece engaging surface 306 abutting the workpiece. The tool 32 is then pressed toward the workpiece to advance the bit 46 through the opening 344 and into engagement with the head 62 of the fastener 34. The fastener is then forced by the bit against the surface of the workpiece. The bit 46 is rotated and the tool 32 is pressed further toward the workpiece in order to drive the fastener into the workpiece.

During the fastener driving operation, it can be seen that the base assembly 302 and nose assembly 304 are moved toward one another during the drive stroke and are moved away from one another by the return spring 338 as the tool 32 is withdrawn from the workpiece. In accordance with an important feature of the present invention, this relative movement during the fastener driving operation is used to operate the feed mechanism 308 in order to advance the fastener strip 36 in increments through the feed path 346.

In general, the feed mechanism 308 includes a feed pawl 372 engagable with the carrier 56 for advancing the carrier through the feed path 346. During the drive operation as the tool 32 is moved toward the workpiece 38, the pawl 372 is advanced from its home position illustrated in FIGS. 19 and 26 to its cocked position illustrated in FIG. 27. Thereafter, as the tool 32 is withdrawn from the workpiece 38, the pawl returns from its cocked position to the home position, and in so doing moves the carrier 56 through one increment of movement in order to advance an adjacent fastener to the drive position.

More specifically, feed pawl 372 is carried at the end of a pawl leg 374 of a pawl lever 376. Lever 376 also includes an actuating leg 378, and the lever 376 is supported for both rotational and tilting movement upon a slotted pivot pin 380. As best appears in FIG. 24, the pawl 372 comprises a bent over end portion of the pawl leg 374. The pawl is provided with a cam surface 382 to lift the pawl from the web portion 64 as the pawl moves from the home position to the cocked position along the carrier 56. Cover plate 324 is provided with a slot 384 through which the pawl 372 extends into engagement with the carrier 56.

A pawl return spring 386 serves to bias the pawl lever 376 toward the home position, and also to bias the pawl 372 inwardly toward the carrier 56. One end 388 of the spring 386 is captured in the slotted pin 380, while the other end 390 of the spring extends along the actuating leg 378 and is captured behind a foot plate segment 392 of the actuating leg 378. Spring 386 therefore urges the lever 376 in a counterclockwise direction as viewed in FIGS. 19, 26 and 27.

Figure 26:
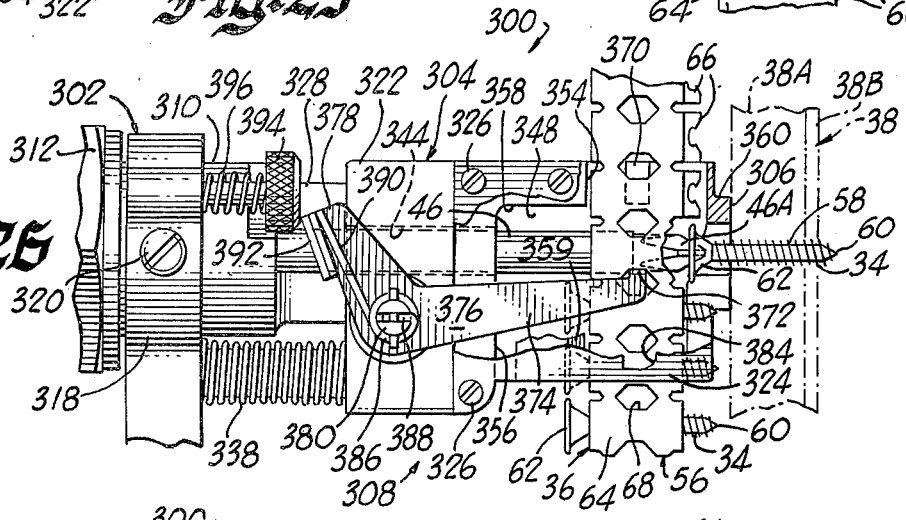
FIG. 26 is a side view similar to a portion of FIG. 19, partly in section, illustrating the assembly of FIG. 19 at an intermediate condition during driving of a fastener.

In accordance with a feature of the invention, the feed mechanism 308 does not interfere with driving of a fastener 34 since the mechanism is not operated until after secure engagement of the bit 46 with a fastener 34 in the drive position. More specifically, as the tool 32 and bit 46 move relative to the nose assembly 304 from the initial position of FIG. 19 to the position of FIG. 26, the pawl lever 376 is not moved. As the position of FIG. 26 is reached, an operating abutment 394 in the form of a screw member threaded into the collar portion 318 of the magazine support element 316 strikes the foot 392 of the actuating leg 378. Only at this time, after bit 46 engages and partially drives fastener 34, is movement imparted to the lever 376.

Figure 27:
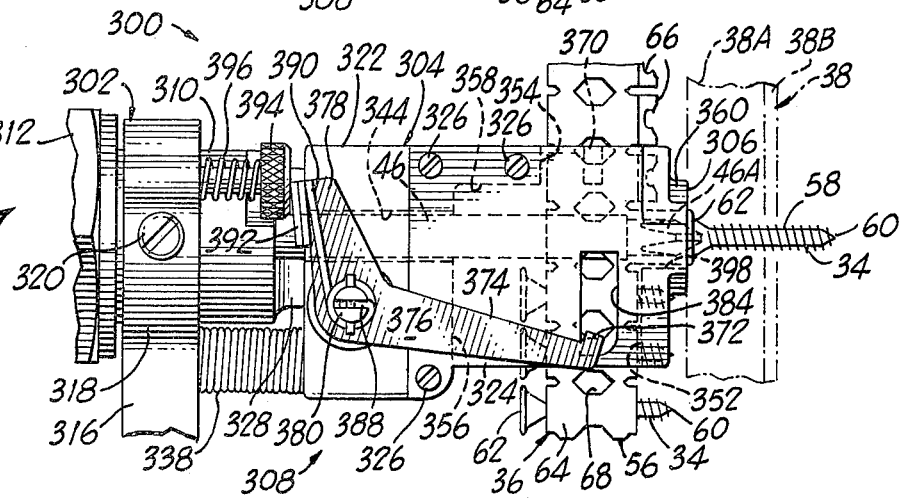
FIG. 27 is a view similar to FIG. 26 illustrating the assembly at the completion of a fastener driving stroke and prior to withdrawal of the tool.

As tool 32 continues to move closer to the workpiece 38 in a drive stroke from the position of FIG. 26 to the position of FIG. 27, the abutment 394 rotates the pawl lever 376 by engagement with the actuating arm 378. Consequently, the pawl 372 moves from its home position to the cocked position illustrated in FIG. 27 as the fastener 34 is advanced to the fully driven position. Due to the somewhat loose mounting of lever 376 on pin 380, the pawl is urged by the cam surface 382 out of opening 68 in the web portion 64 and over the web portion 64. When the fastener 32 is fully driven, the pawl is in its cocked position illustrated in FIG. 27.

The abutment 394 in combination with the foot plate 392 provides for adjustment of the length of drive stroke carried out during a fastener driving operation. More specifically, and as can be seen in FIG. 20, the foot plate 392 overlies the rear surface of the nose block 322. In the fully driven position, the abutment 394 moves the foot plate 392 into engagement with the block 322 (FIG. 27) and no further movement of the base assembly 302 toward the nose assembly 304 is possible. Screw number 394 is adjustable by threading into and out of the base assembly 302 in order to adjust the length of the drive stroke thereby to adjust the degree of countersink of fasteners 34. A tensioning spring 396 is provided to prevent inadvertent misadjustment of the position of the abutment 394.

At the completion of a drive stroke, the tool 32 is withdrawn away from the workpiece 38. As this occurs, the pawl return spring 386 causes the lever 376 to move in a counterclockwise direction as illustrated in FIGS. 26 and 27. As a result, the pawl 372 returns from its cocked position to its home position. When the pawl comes into engagement with an opening 68, the pawl enters the opening due to the force applied to the pawl by spring 386. After entering the opening 68, the continuing movement of the pawl drives the strip 34 through an increment of movement in order to locate the next adjacent fastener 34 in the drive position. In the home position, further movement is prevented by engagement of the pawl with the end of the slot 384.

In accordance with a feature of the invention, reverse movement of the fastener strip 36 during cocking of the pawl is prevented without the necessity of a stop pawl or the like. More specifically, during the initial portion of the drive stroke, prior to movement of the lever 376, tabs 66 are deformed and bent to an angular position relative to the base or web portion 64. The outermost tab 66 moves to overlie a stop shoulder 398 defined on the nose block 322. Consequently, upon deformation of the tab, engagement between the tab 66 and the stop surface 398 effectively prevents movement of the fastener strip 36 in the reverse direction through the feed path 346.

Having reference now to FIGS. 28–36, there is illustrated a fastener feed assembly generally designated by the reference numeral 400 and comprising yet another alternative embodiment of the present invention. Feed assembly 400 is mounted on fastener driving tool 32 and serves to feed individual fasteners 34 from fastener strip 36 for driving of the fasteners into a workpiece 38 (FIGS. 35 and 36) consisting in the illustrated arrangement of a drywall panel 38A and a metal stud 38B. Since the tool 32, fasteners 34, strip 36 and magazine 72 have been described above in connection with the embodiment of FIGS. 1–18, identical reference numerals are used for identical parts in FIGS. 28–36 and further detailed description is unnecessary.

In general, the fastener feed assembly 400 includes a base assembly 402 adapted to be mounted to the tool 32, as well as a nose assembly 404 having a workpiece engaging surface 406 engageable with the workpiece 38 during the fastener driving operation. The base assembly 402 and nose assembly 404 are movable relative to one another as the tool 32 is moved toward and then withdrawn from the workpiece. In accordance with the invention there is provided a feed mechanism generally designated by the reference numeral 408 and operated in response to relative movement of the nose assembly 404 and base assembly 402 for advancing the fastener strip 36 in increments in order to locate individual fasteners in sequence for driving by the tool 32.

Proceeding to a more detailed description of the fastener feed assembly 400, the base assembly 402 includes a generally cylindrical clutch housing 410 adapted to be attached to the housing 40 of tool 32. In the illustrated arrangement, the housing 410 includes an internally threaded collar portion 412 threaded onto a boss 414 carried by the tool housing. A depending leg 416 extending from collar 412 serves to support the magazine 72 in position beneath the tool 32.

The forward end of the housing 410 includes a pair of projecting portions 418 and 420 defining a pair of flat, parallel support walls 422 and 424. A mounting plate 426 is held firmly against the wall 422 by means of a screw 428, and a slide plate 430 is similarly held firmly to wall 424 by means of a pair of screws 432.

Figure 29:
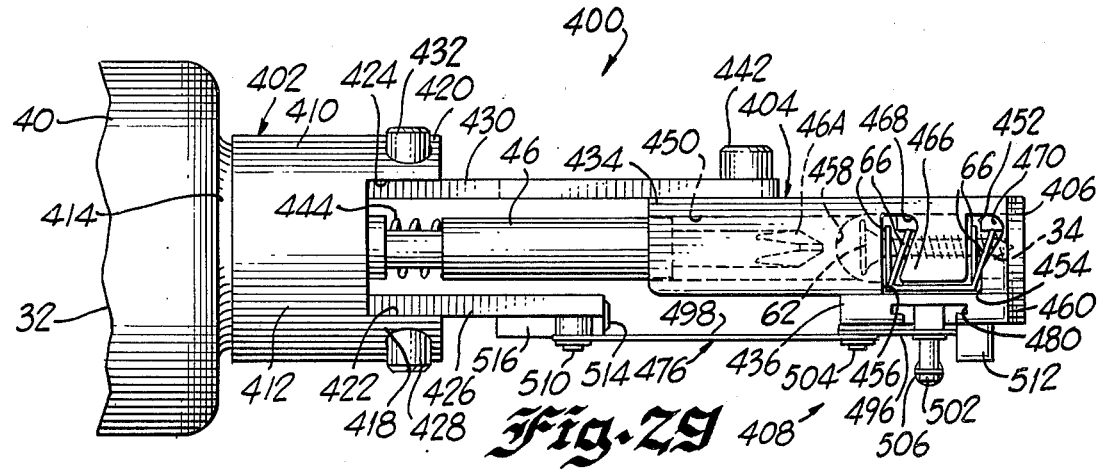
FIG. 29 is a top plan view of the assembly of FIG. 28.
Figure 30:
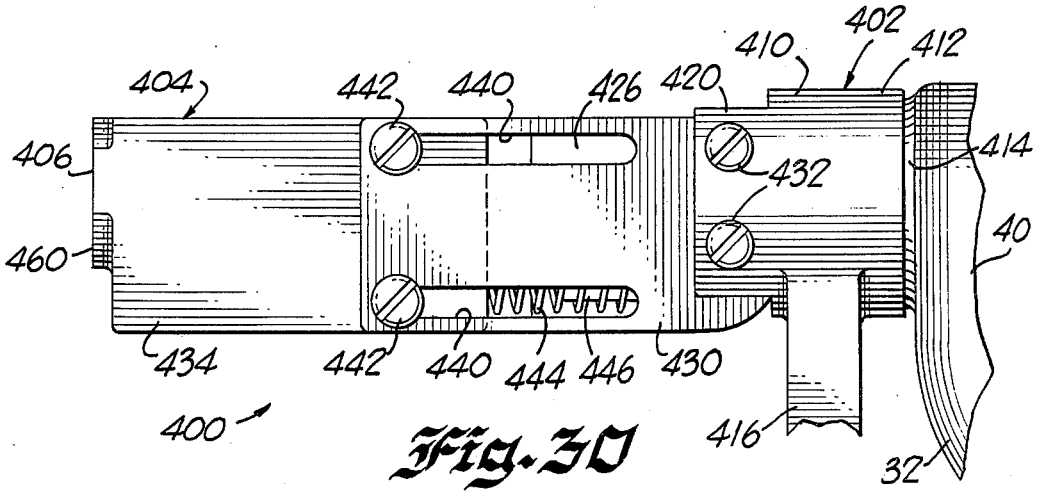
FIG. 30 is a side elevational view illustrating the side of the assembly opposite that shown in FIG. 28.

Nose assembly 404 includes a nose block 434 to one side of which a cover plate 436 is attached by screws 438. The nose assembly 404 is mounted for reciprocal movement relative to the base assembly 402. As can best be seen in FIGS. 29 and 31, the nose block 434 is of a thickness to be slidably received between the mounting plate 426 and the slide plate 430. Slide plate 430 includes a pair of parallel slots 440 slidably receiving a pair of slide screws 442 carried by the nose block 434. The outermost position of the nose assembly 404 relative to base assembly 402 is established by engagement of the screws 442 with the ends of slots 440 as illustrated in FIG. 30.

A return spring 444 is held in compression between the base assembly 402 and nose assembly 404 in order to urge the nose assembly 404 toward its outermost position. A spring retaining pin 446 is mounted on the clutch housing 410 and extends toward the nose assembly 404. The spring 444 and pin 446 are slidably received in an aligned opening 448 in the nose block 434. The opening is of sufficient depth to permit reciprocal movement of the nose assembly 404 relative to the base assembly 402.

The drive member or bit 46 is concentric with and extends through the housing 410 toward the nose assembly 404. The nose block 434 is provided with an opening or drive channel 450 receiving the bit 46 and permitting both longitudinal and rotational movement of the bit with respect to the block 434.

In order to permit feeding of the fastener strip 36 through the nose assembly 404 for registration of individual fasteners 34 in sequence with the bit 46, a feed path 452 is defined in the nose block 434. The web portion 64 of the carrier 56 moves along the inner wall of the cover plate 436 (FIGS. 29 and 31) while the tabs 66 are captured between a pair of guide walls 454 and 456. A generally cylindrical wall 458 defines an enlarged area for entry of the heads 62 of the fasteners 34 into the nose block 434. The workpiece engaging surface 406 of the nose assembly 404 is defined on the nose block 434 opposite the wall 454, and specifically on the end of a cylindrical locating boss portion 460 of the nose block 434. Preferably, prior to being driven by the bit 46, the tips 60 of the fasteners 34 do not extend beyond the work engaging surface 406.

In order to guard the region through which the bit 46 moves to drive a fastener 34 from the strip 36, the feed path 452 is largely covered by the nose block 434 and cover plate 436. Near the entry end of the feed path 452, the block 434 is provided with a guiding protuberance 462 (FIG. 31) serving to overlie the shanks 58 of the fasteners 34 and to maintain the web portion 64 of the carrier 56 against the cover plate 436. The tips of the tabs 66 are received in a pair of guideways 464 flanking the protuberance 462.

At the exit end of the feed path 452, the nose block 434 is provided with another guide portuberance 466 serving to direct the carrier 56 from the nose assembly 404. As best shown in FIG. 29, protuberance 466 extends to a region closely overlying the web 64 for maintaining the carrier 56 in position as the last few fasteners of the strip are driven. Protuberance 466 is flanked by a pair of slots 468 and 470 through which the tabs 66 move from the nose assembly 404.

The strip 34 after being loaded into the magazine 72 is fed into the nose assembly 404 by inserting the leading end of the strip over the protuberance 462 and into the feed path 452. A first fastener 34 of the strip 36 is located in a drive position in line with the bit 46 and its drive channel 450. Once the fastener strip 36 has been initially loaded into the feed path with a fastener 34 located in the drive position, a fastener driving operation can be carried out. The nose assembly 404 is placed against the workpiece 38 with the workpiece engaging surface 406 abutting the workpiece. The tool 32 is then pressed toward the workpiece in order to advance the bit 46 through the opening 450 and into engagement with the head 62 of the fastener 34. The fastener is then forced by the bit 46 against the surface of the workpiece. The bit 46 is rotated and the tool 32 is pressed further toward the workpiece in order to drive the fastener into the workpiece.

During the fastener driving operation, the base assembly 402 and nose assembly 404 are moved toward one another during the drive stroke and are separated by the return spring 444 as the tool 32 is withdrawn from the workpiece. In accordance with an important feature of the present invention, this relative movement during the fastener driving operation is used to actuate the feed mechanism 408 in order to advance the fastener strip 36 in increments through the feed path 346.

In general, the feed mechanism 408 includes a feed pawl associated with a pawl slide 474. A drive linkage generally designated as 476 causes the pawl 472 to move between a home position (FIGS. 28, 32, 33 and 35) to a cocked position (FIG. 36) as the base assembly 402 is moved toward the nose assembly 404. Conversely, when the base assembly 402 moves away from the nose assembly 404, the pawl 472 is returned in the opposite direction to its home position in order to advance the fastener strip 36 through one increment of movement along the feed path 452. In accordance with the invention, a lost motion connection generally designated as 478 is associated with the drive linkage 476 in order to insure that operation of the feed mechanism 408 does not interfere with the driving of a fastener 34 by the bit 46.

The pawl slide 474 is mounted for sliding movement in a slide track 480 formed in the cover plate 436 and extending generally parallel to the path of movement of the fastener strip 36 through the nose assembly 404. The slide 474 includes a pair of extending guide flanges of reduced width 482 for capturing the slide within the track 480.

Figures 31, 32, 33, 34, 35, 36:
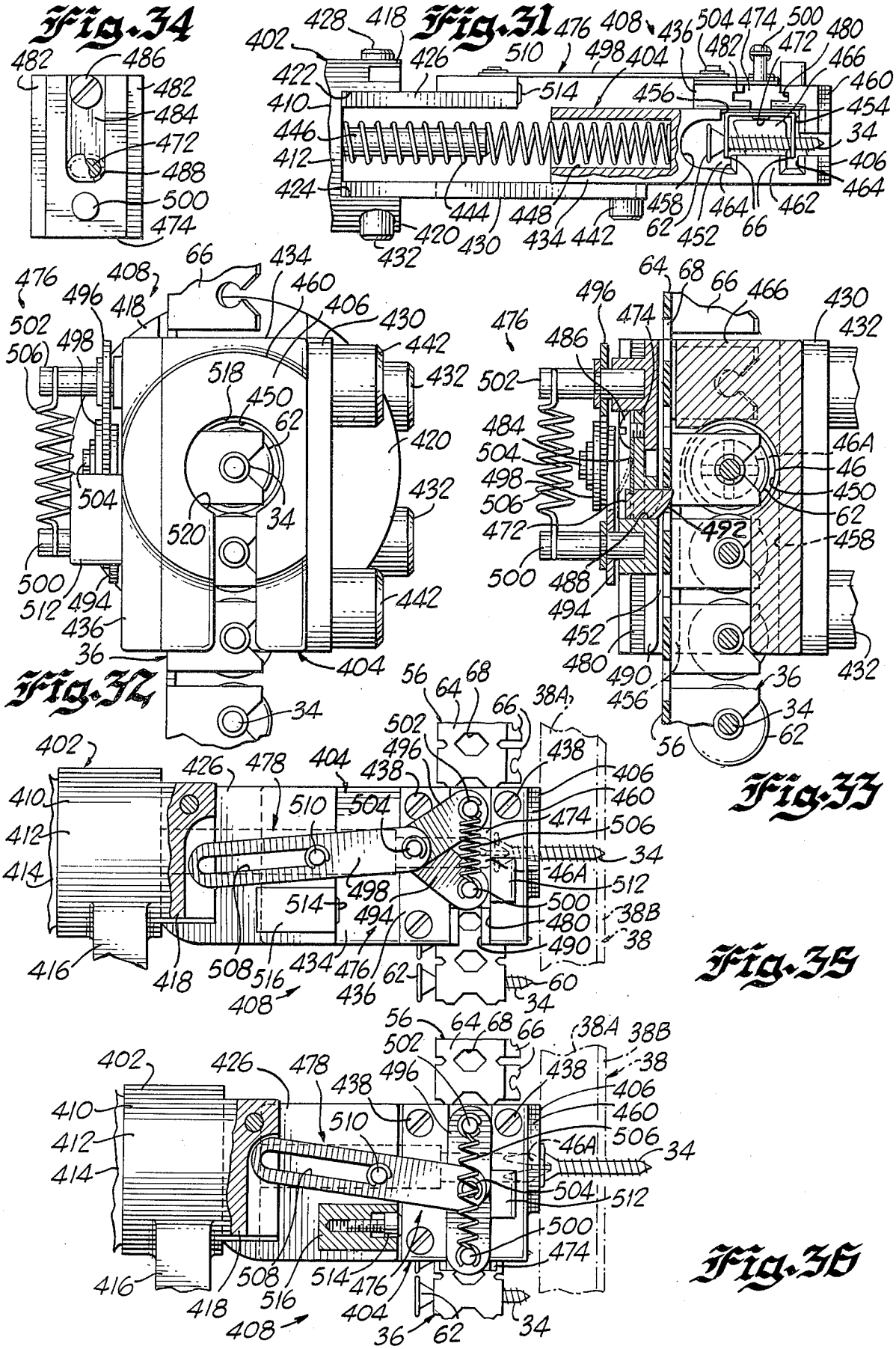
FIG. 31 is a bottom view of the assembly of FIG. 28.
FIG. 32 is a front view, on an enlarged scale, of the assembly of FIG. 28.
FIG. 33 is a sectional view on an enlarged scale taken along the line 33—33 of FIG. 28.
FIG. 34 is a side view, partly broken away and on an enlarged scale, of the pawl slide member of the assembly of FIG. 28.
FIG. 35 is a view similar to part of FIG. 28 illustrating the assembly of FIG. 19 at an intermediate condition during driving of a fastener.
FIG. 36 is a view similar to FIG. 35 illustrating the assembly of the completion of a fastener driving stroke and prior to withdrawal of the tool.

As best seen in FIGS. 33 and 34, the pawl 472 is carried on a spring member 484 attached to the slide 474 by a screw 486. Pawl 472 is slidably mounted in an opening 488 extending through the body of the slide 474, and the spring member 484 biases the pawl 472 toward the carrier 56, while permitting movement of the pawl outwardly from the web portion 64 of the carrier.

Entry of the pawl 472 into the openings 68 in the web 64 is permitted by a slot 490 in the cover plate 436. As the pawl 472 and slide 474 move from the home position of FIG. 35 to the cocked position, a cam surface 492 on the pawl 472 lifts the pawl 472 against the force of the spring 484 to permit the pawl to move over the web portion 64 of the carrier 56. During the return movement of the slide 474, the spring 484 moves the pawl 472 into the next adjacent opening 68 so that continued movement of the slide 474 to the home position results in movement of the fastener strip 36 through one increment of movement.

In accordance with the invention, the drive linkage 476 includes a pair of toggle links 494 and 496 drivingly coupled to the base assembly 402 by means of a drive link 498 and the lost motion connection 478. More specifically, the toggle link 494 is pivoted on a pin 500 carried on the pawl slide, while the other toggle link 496 is pivotally mounted on a pin 502 carried on the cover plate 436. The opposite ends of both toggle links 494 and 496 are pivotally connected to the end of the drive link 498 by a pin 504. A pawl return spring 506 is connected in tension between the pins 500 and 502 in order to bias the slide 474 to its home position.

During a fastener driving stroke of the tool 32, due to the lost motion connection 478, the drive linkage 476 does not operate to move the pawl 472 to its cocked position until after secure engagement of the bit 46 with a fastener 34. The drive link 498 includes a slot 508 slidably receiving a drive pin 510 carried on the mounting plate 426. During the initial part of a drive stroke as the nose assembly 404 moves relative to the base assembly 402 from the position illustrated in FIG. 35 to the position illustrated in FIG. 36, the drive pin 510 simply moves in the slot 508 and imparts no axial movement to the drive link 498. As the base assembly 402 reaches the position illustrated in FIG. 35, the bit 46 engages and partly drives the fastener 34. At this time, the drive pin 510 reaches the end of slot 508 and begins to force the toggle links 494 and 496 apart.

During the remainder of the drive stroke, the links 494 and 496 are moved from the position illustrated in FIG. 35 to the position illustrated in FIG. 36. As a result, the slide 474 is moved along the slide track 480 and the pawl 472 is moved from its home position to its cocked position.

In accordance with a feature of the invention, the drive linkage 476 does not operate the pawl 472 in a carrier strip feed stroke until after the bit 46 is substantially withdrawn from the region of the carrier 56. More specifically, in the position of FIG. 36, the toggle links 494 and 496 are substantially in a straight line and are effectively locked in position by the pawl return spring 506. In this position, the force of the pawl return spring 506 is substantially along a line through or near the pivot pin 504 so that the spring does not cause movement of the toggle links. As base assembly 402 is withdrawn, the drive pin 510 slides in the reverse direction along the slot 508.

Figure 28:
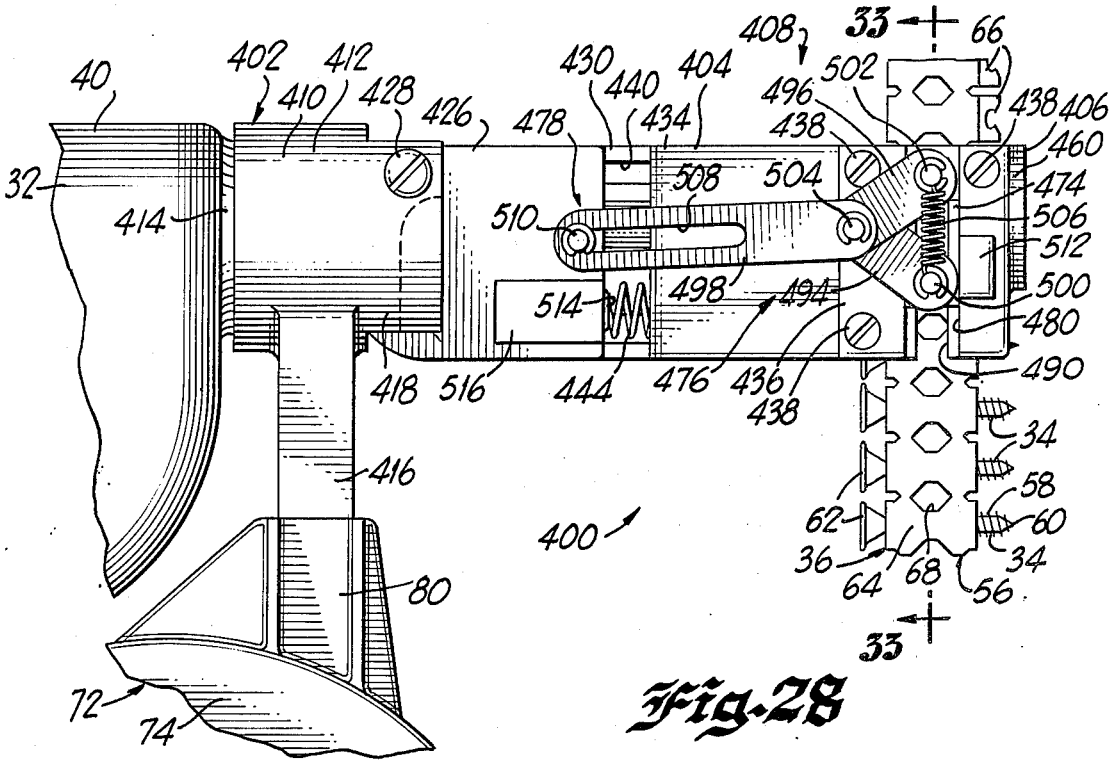
FIG. 28 is a fragmentary side elevational view of a fastener feed assembly comprising an alternative embodiment of the present invention.

When the pin 510 reaches the opposite end of the slot 508, it withdraws the drive link 498 and the pin 504 moves to the left as illustrated in FIG. 28 out from beneath the pawl return spring 506. At this point, the spring is effective to pull the pins 500 and 502 toward one another so that the pawl slide 474 moves through the slide track 480 to return the pawl 472 to its home position.

In the fully driven position of a fastener 34 (FIG. 36) movement of the toggle links 494 and 496 beyond the desired in line position is prevented by engagement of the links with an abutment 512 formed on the cover plate 436. The distance of movement of the base assembly 402 relative to the nose assembly 404, and thus the degree of countersink of a fastener 34, may be adjusted by means of an adjustable abutment screw 514 (FIG. 36) carried in an enlarged portion 516 of the mounting plate 426.

With reference now to FIG. 32, it can be seen that the boss 460 is provided with a generally cylindrical passageway 518 through which a fastener 34 is driven during a drive stroke. As the fastener is driven, the lowermost tab 66 of the carrier 56 is deflected outwardly through the opening 518. In this deflected condition, the tab 66 overlies a stop portion 520 of the wall of opening 518. Consequently, movement of the fastener strip 36 in the reverse direction during cocking of the pawl is prevented without the necessity for a return pawl or the like.

While the invention has been described with reference to details of the illustrated embodiments, it should be understood that such details are not intended to limit the invention as defined in the following claims.

What is claimed and desired to be secured by Letters Patent of the United States is:

1. In combination with a power screwdriver having a main housing portion and a handle defining an included angle in a plane and having a rotatable bit generally in line with the main housing portion; a fastener feed apparatus comprising:

a strip of fasteners including a coil, each fastener being arranged generally perpendicular to the principal axis of the adjacent segment of the strip;

a magazine enclosing said coil with the coil lying generally in the plane of said angle and within said included angle;

a feed mechanism mounted on said main housing portion and including means for sequentially presenting individual fasteners of the strip to a drive position in line with said bit; and a segment of said strip extending along a curved path between said magazine and said feed mechanism being twisted through a substantial angle.

2. The feed apparatus of claim 1, said strip comprising a flexible carrier strip having a continuous web portion and opposed pairs of fastener holding tabs carried by said web portion.

3. The feed apparatus of claim 1, said angle comprising approximately ninety degrees.

4. A fastener feed assembly for supplying fasteners to the drive member of a fastener driving tool, said assembly comprising:

a flexible carrier strip including a web portion;

a plurality of tabs extending from said web portions for holding said fasteners;

nose means adapted to be carried by said tool and defining a carrier strip feed path for presenting said fasteners to a drive position;

means defining a drive path through said nose means for movement of said drive member in a drive stroke transverse to the feed path and intersecting the feed path at said drive position, said tabs being individually deformable from a first position to a second position during said drive stroke;

means for sequentially advancing said carrier strip in increments to position successive fasteners in said drive position;

and a stop surface adjacent said feed path facing in the direction of feed of said carrier strip and disposed adjacent said drive position for engagement with said tabs in said second position.

5. A method of automatically feeding screws from a strip to a position in line with the bit of a power screwdriver having a nose assembly, said method comprising the steps of:

supporting one screw of the strip in the nose assembly in line with the bit;

pushing the screwdriver toward a workpiece in order to engage the bit with said one screw and rotating the bit to drive the screw from the nose assembly into the workpiece;

retracting a pawl along the strip to a cocked position during said pushing step;

deforming aa spring between the pawl and the nose assembly during said pushing step;

withdrawing said screwdriver away from the workpiece; and releasing the spring to apply the force of said spring to said pawl to advance said pawl to a home position during said withdrawing step in order to move an adjacent screw into line with the bit.

6. The method of claim 5, said deforming step being carried out by applying to said spring a force developed by said pushing.

7. The method of claim 5, said method further comprising delaying said retracting step until after engagement of said bit with the screw.

8. The method of claim 5, said method further comprising holding said pawl in the cocked position during the initial part of said withdrawing step.

9. The method of claim 5, said method further comprising deflecting a portion of said strip into alignment with a stop during driving of said screw to prevent reverse movement of the strip.

10. In combination with a fastener driving tool for driving fasteners in the direction of their major axis into a workpiece, a feed assembly comprising:

a carrier strip including a series of the fasteners each supported generally perpendicular to the major axis of the adjacent portion of said strip;

a magazine supported on said tool and containing a supply of said strip;

a nose assembly mounted on said tool for reciprocal movement relative to the tool during a fastener drive operation;

means defining a feed path through said nose assembly for said strip wherein a fastener of the strip is located in a drive position;

strip advancing means for moving said strip in increments along said feed path; and a segment of said strip disposed between said magazine and said nose assembly twisted around its major axis through a substantial angle.

11. The feed assembly of claim 10 wherein said substantial angle is in excess of forty-five degrees.

12. The feed assembly of claim 10 wherein said substantial angle is approximately ninety degrees.

13. Fastener feed apparatus for a tool including a rotatable drive member for driving rotary entry fasteners into a workpiece, said feed apparatus comprising a base adapted to be mounted on the tool, a workpiece engaging nose assembly mounted for reciprocal movement toward the base as the tool is pressed toward the workpiece in a fastener driving operation, a return spring compressed between the base and the nose assembly for moving the nose assembly away from the base as the tool is withdrawn from the workpiece, a fastener strip including an elongated carrier member supporting fasteners in spaced positions therealong, said nose assembly defining a drive path for movement of the drive member through the nose assembly in a drive stroke toward the workpiece and defining a feed path intersecting the drive path for supporting the fastener strip in the nose assembly with a fastener aligned with the drive member, said fastener feed assembly being characterized by a series of pawl engagement structures located along the fastener strip carrier member, pawl means engageable with the pawl engagement structures and mounted on the nose assembly for movement along the feed path between a cocked position and a home position wherein a fastener is in alignment with the drive member, a pawl spring biasing the pawl means toward the home position, abutment means on said nose assembly engageable by the pawl means and defining the home position, and linkage means for moving said pawl means to the cocked position in response to movement of the nose assembly toward the base assembly and for freeing the pawl means during movement of the nose assembly away from the base for permitting the pawl spring to return the pawl means to the home position.

14. Fastener feed apparatus as claimed in claim 13, said linkage means including locking means for retaining the pawl means in the cocked position, and means for releasing said locking means to free the pawl means during movement of said nose assembly away from said base.

15. Fastener feed apparatus as claimed in claim 13, further comprising a magazine adapted to be supported by said tool for containing a supply of the fastener strip, the fasteners of the strip being each supported generally perpendicular to the major axis of the adjacent portion of the strip, and a segment of the strip disposed between the magazine and the nose assembly being twisted around its major axis through a substantial angle.

16. Fastener feed apparatus as claimed in claim 13 further comprising a stop surface in the nose assembly adjacent the feed path, tab means on the carrier member for holding the fasteners, said tab means being deformable to an inclined position by the drive member in a drive stroke, the tab means in the inclined position overlying the stop surface to prevent reverse movement of the fastener strip along the feed path.

17. Fastener feed apparatus as claimed in claim 13, each said pawl engagement structure comprising an opening in the fastener strip carrier member.

18. Fastener feed apparatus as claimed in claim 17, the carrier member comprising an elongated web having spaced tabs extending from the web for holding fasteners.

19. Fastener feed apparatus as claimed in claim 13, said linkage means including lost motion means for delaying movement of the pawl means away from the home position in a drive stroke until after secure engagement of the drive member with a fastener.

20. Fastener feed apparatus as claimed in claim 14, said linkage means being effective to release said locking means only after withdrawal of the drive member from the feed path.

21. Fastener feed apparatus as claimed in claim 17, said pawl means comprising a lever pivotally and somewhat loosely mounted on said nose assembly, a pawl on said lever, and said pawl spring biasing said pawl against said carrier member.

22. Fastener feed apparatus as claimed in claim 21, said linkage means comprising a drive link pivoted to said lever and slidably and pivotally coupled to said base.

23. Fastener feed apparatus as claimed in claim 13, further comprising adjustment means between the base and the nose assembly for adjusting the length of the drive stroke.

* * * * *